US011684141B1

(12) United States Patent
Storms, Jr. et al.

(10) Patent No.: US 11,684,141 B1
(45) Date of Patent: Jun. 27, 2023

(54) MULTI-PANEL ATTACHMENT SYSTEM

(71) Applicant: Sentry Solutions Products Group LLC, Virginia Beach, VA (US)

(72) Inventors: Frederick W. Storms, Jr., Virginia Beach, VA (US); Eric M. Yeates, Virginia Beach, VA (US)

(73) Assignee: Sentry Solutions Products Group LLC, Virginia Beach, VA (US)

( * ) Notice: Subject to any disclaimer, the term of this patent is extended or adjusted under 35 U.S.C. 154(b) by 0 days.

(21) Appl. No.: 17/676,681

(22) Filed: Feb. 21, 2022

Related U.S. Application Data

(63) Continuation-in-part of application No. 17/397,715, filed on Aug. 9, 2021.

(60) Provisional application No. 63/151,437, filed on Feb. 19, 2021, provisional application No. 63/062,483, filed on Aug. 7, 2020.

(51) Int. Cl.
*A45F 5/00* (2006.01)

(52) U.S. Cl.
CPC ..... *A45F 5/00* (2013.01)

(58) Field of Classification Search
CPC ..... B65D 63/1027; A44B 11/20; A45F 5/021
See application file for complete search history.

(56) References Cited

U.S. PATENT DOCUMENTS 6,840,420 B1 * 1/2005 Hudson ..... A44C 3/001 224/675
7,963,427 B2 * 6/2011 Calkin ..... A41D 13/0012 224/675
9,521,897 B2 * 12/2016 Thompson ..... A45F 5/02
9,565,922 B2 * 2/2017 Cole ..... A45F 5/02
10,264,874 B2 * 4/2019 Becker ..... A45F 3/14
10,944,140 B2 * 3/2021 Thiel ..... H01M 50/207
11,299,101 B2 * 4/2022 Busse ..... B60R 7/043
2013/0181019 A1 * 7/2013 Salentine ..... A45F 5/021 2/102
2015/0335140 A1 * 11/2015 Cole ..... A45F 5/021 24/3.1
2019/0394910 A1 * 12/2019 Frazier ..... A45F 3/06

* cited by examiner

*Primary Examiner* — David M Upchurch

(74) *Attorney, Agent, or Firm* — Shaddock Law Group, PC

(57) ABSTRACT

A multi-panel attachment system including an attachment interface panel having accessory attachment elements extending from an attachment interface portion, accessory attachment slots are formed through the attachment interface portion, at least a portion of the attachment interface panel is attachable to an accessory, and accessory apertures are formed through the accessory; an attachment panel having panel attachment elements extending from a panel interface portion, panel attachment slots are formed through the panel interface portion, and the attachment panel is releasably attachable to the attachment interface panel via interaction between the accessory apertures, the panel attachment slots, and panel attachment elements; and a flap panel having a flap interface portion, flap attachment slots are formed through the flap interface portion, and the flap panel is releasably attachable to the attachment interface panel via interaction between the accessory attachment slots, the flap attachment slots, and the accessory attachment elements.

20 Claims, 20 Drawing Sheets

MULTI-PANEL ATTACHMENT SYSTEM

CROSS-REFERENCE TO RELATED APPLICATIONS

This patent application claims the benefit of U.S. patent application Ser. No. 63/151,437, filed Feb. 19, 2021, and is a continuation-in-part of U.S. patent application Ser. No. 17/397,715, filed Aug. 9, 2021, which claims the benefit of U.S. patent application Ser. No. 63/062,483, filed Aug. 7, 2020, the disclosures of which are incorporated herein by reference their entireties.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of modular attachment systems. More specifically, the present disclosure relates to a multi-panel attachment system.

2. Description of Related Art

It is advantageous be able to configure and/or reconfigure various pouches, pockets, holsters, holders, and other accessories on items such as, for example, articles of clothing, vests, plate carriers, backpacks, packs, platforms, and other carriers.

It is generally known to removably attach such items using a MOLLE or other similar attachment system. The term MOLLE (Modular Lightweight Load-carrying Equipment) is used to generically describe load bearing systems and subsystems that utilize corresponding rows of interwoven webbing for modular pouch, pocket, and accessory attachment interface.

The MOLLE system is a modular system that incorporates the use of corresponding rows of webbing stitched onto a piece of equipment, such as a vest, and the various MOLLE compatible pouches, pockets, and accessories, each accessory having mating rows of stitched webbing. MOLLE compatible pouches, pockets, and accessories of various utility can then be attached or coupled wherever MOLLE webbing exists on the equipment.

The terms "MOLLE-compatible" or "MOLLE" system are not used to describe a specific system, but to generically describe accessory attachment interface systems that utilize interwoven PALS (Pouch Attachment Ladder System) webbing for modular accessory rear attachment interface portions.

An exemplary MOLLE compatible carrier portion includes a plurality of substantially parallel rows of spaced apart, horizontal carrier webbing elements. Each of the carrier webbing elements is secured to a backing or carrier material, by vertical stitching, at spaced apart locations, such that a tunnel segment is formed between the carrier material and the carrier webbing elements between each secured location of the carrier webbing elements. Each of the tunnel segments is formed substantially perpendicular to a longitudinal axis or direction of the carrier webbing elements.

The MOLLE compatible carrier portion, or MOLLE system grid, typically consists of horizontal rows of 1 inch (2.5 cm) webbing, spaced 1 inch apart, and attached or coupled to the carrier material at 1.5 inch (3.8 cm) intervals.

An exemplary accessory includes a plurality of substantially parallel, spaced apart accessory webbing elements. The accessory webbing elements are spaced apart so as to correspond to the spaces between the spaced apart carrier webbing elements. The accessory webbing elements are secured to the accessory at spaced apart locations, such that an accessory tunnel segment is formed between the accessory and the accessory webbing element between each secured location of the accessory webbing element. Each of the accessory tunnel segments is formed substantially perpendicular to a longitudinal direction of the accessory webbing elements.

When the accessory is placed adjacent the carrier material such that the accessory webbing elements are within the spaces between the spaced apart carrier webbing elements (and the carrier webbing elements are within the spaces between the spaced apart accessory webbing elements) and corresponding tunnel segments and accessory tunnel segments are aligned, a strap or coupling element may be interwoven between the aligned tunnel segments and accessory tunnel segments (alternating between horizontal carrier webbing element portions on the host or carrier material and horizontal webbing portions on the accessory) to removably attach the accessory to the carrier material.

Thus, through the use of a MOLLE or MOLLE-type system, an accessory may be mounted to a variety of carrier materials. Likewise, if a particular carrier material includes a MOLLE compatible system, a variety of accessories may be interchangeably mounted to the platform to accommodate a variety of desired configurations.

MOLLE compatible systems allow, for example, various pouch arrangements to be specifically tailored to a desired configuration and then reconfigured, if desired. Various desired pouches, pockets, and accessories can be added and undesired or unnecessary pouches, pockets, or accessories can be removed.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

However, the typical "MOLLE-compatible" or "MOLLE" accessory has various shortcomings. For example, known "MOLLE-compatible" or "MOLLE" systems typically utilize strap or coupling elements that are either separate portions of material sewn to the accessory or separate, discrete portions of plastic or other material. If sewn, the strap or coupling elements can be separated from the accessory. If the strap or coupling elements comprise separate portions of plastic other material, the strap or coupling elements can be lost or misplaced. In either case, the bulk of known strap or coupling elements typically creates a significant gap between the accessory and the carrier material, when interwoven between the accessory in the carrier material.

Additionally, if the accessories include a flap, the flap is typically an integral portion of the accessory or attached in a way that it is not repeatably attachable and/or removable. Likewise, the element or elements for securing the flap in a closed position are not repeatably attachable and/or removable.

In order to solve these and other shortcomings of known "MOLLE-compatible" other known accessories and/or other attachment interfaces and to provide certain advantages over known "MOLLE-compatible" and/or other attachment interfaces, the multi-panel attachment system of the present disclosure provides at least some of an attachment interface panel having an attachment interface portion and one or more accessory attachment elements extending from the attachment interface portion, wherein accessory attachment slots are formed through the attachment interface portion, wherein at least a portion of the attachment interface panel is attached or coupled to a portion of an accessory, and wherein accessory apertures are formed through the accessory; an attachment panel having a panel interface portion and one or more panel attachment elements extending from the panel interface portion, wherein panel attachment slots are formed through the panel interface portion, wherein a panel releasable fastener portion is included within at least a portion of the panel interface portion, and wherein the attachment panel is releasably attachable to the attachment interface panel via interaction between the accessory apertures, the panel attachment slots, and panel attachment elements; and a flap panel having a flap interface portion and a flap cover portion, wherein flap attachment slots are formed through the flap interface portion, wherein a flap releasable fastener portion is included within at least a portion of the flap cover portion, and wherein the flap panel is releasably attachable to the attachment interface panel via interaction between the accessory attachment slots, the flap attachment slots, and the accessory attachment elements.

In certain exemplary, nonlimiting embodiments, each of the accessory apertures comprises substantially parallel sides, wherein an arcuate side joins respective upper terminal ends and respective lower terminal ends of each of the parallel sides.

In certain exemplary, nonlimiting embodiments, the accessory apertures are formed through a front portion of the accessory.

In certain exemplary, nonlimiting embodiments, the one or more accessory attachment elements are formed as integral extensions of the attachment interface portion.

In certain exemplary, nonlimiting embodiments, the one or more panel attachment elements are formed as integral extensions of the panel interface portion.

In certain exemplary, nonlimiting embodiments, attachment element notches are defined by recesses formed in opposing side portions of each accessory attachment element, proximate a terminating portion of each accessory attachment element.

In certain exemplary, nonlimiting embodiments, the accessory attachment slots are arranged in a repeating or semi-repeating series or sequence of spaced apart apertures.

In certain exemplary, nonlimiting embodiments, the panel attachment slots are arranged in a repeating or semi-repeating series or sequence of spaced apart apertures.

In certain exemplary, nonlimiting embodiments, the flap attachment slots are arranged in a repeating or semi-repeating series or sequence of spaced apart apertures.

In certain exemplary, nonlimiting embodiments, the multi-panel attachment system of the present disclosure provides an accessory having one or more accessory apertures formed through the accessory; an attachment interface panel having an attachment interface portion and one or more accessory attachment elements extending from the attachment interface portion, the attachment interface portion having accessory attachment slots formed through the attachment interface portion, at least a portion of the attachment interface panel being attached or coupled to a portion of the accessory; an attachment panel having a panel interface portion and one or more panel attachment elements extending from the panel interface portion, the panel interface portion having panel attachment slots formed through the panel interface portion, at least a portion of the panel interface portion having a panel releasable fastener portion, and the attachment panel being releasably attachable to the attachment interface panel via interaction between the accessory apertures, the panel attachment slots, and panel attachment elements; and a flap panel having a flap interface portion and a flap cover portion, the flap interface portion having flap attachment slots formed through the flap interface portion, at least a portion of the flap cover portion having a flap releasable fastener portion, and the flap panel being releasably attachable to the attachment interface panel via interaction between the accessory attachment slots, the flap attachment slots, and the accessory attachment elements.

In certain exemplary, nonlimiting embodiments, the multi-panel attachment system of the present disclosure provides an attachment interface panel having an attachment interface portion and one or more accessory attachment elements extending from the attachment interface portion, wherein accessory attachment slots are formed through the attachment interface portion, wherein at least a portion of the attachment interface panel is attachable to a portion of an accessory, and wherein accessory apertures are formed through the accessory; an attachment panel having a panel interface portion and one or more panel attachment elements extending from the panel interface portion, wherein panel attachment slots are formed through the panel interface portion, and wherein the attachment panel is releasably attachable to the attachment interface panel via interaction between the accessory apertures, the panel attachment slots, and panel attachment elements; and a flap panel having a flap interface portion and a flap cover portion, wherein flap attachment slots are formed through the flap interface portion, and wherein the flap panel is releasably attachable to the attachment interface panel via interaction between the accessory attachment slots, the flap attachment slots, and the accessory attachment elements.

Accordingly, the present disclosure separately and optionally provides a multi-panel attachment system that allows a user to readily attach an accessory to at least a portion of a carrier or carrier material.

The present disclosure separately and optionally provides a multi-panel attachment system that allows a flap and/or flap attachment interface to be removably attached or coupled to an accessory.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures.

While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF EXEMPLARY EMBODIMENTS OF THE PRESENT DISCLOSURE

Figure 1:
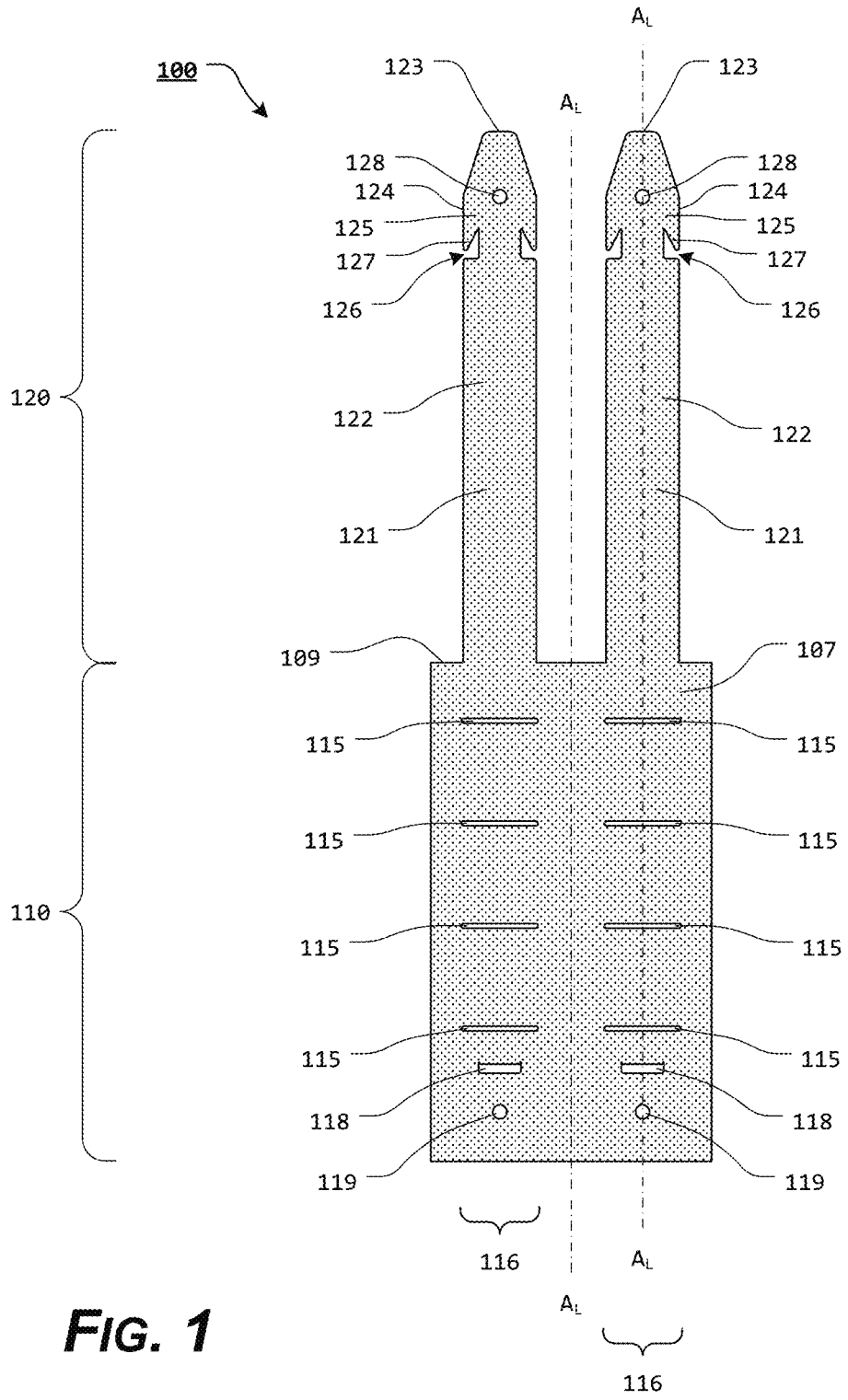
FIG. 1 illustrates a front view of an exemplary embodiment of an optional attachment interface panel of a multi-panel attachment system, according to the present disclosure.
Figure 2:
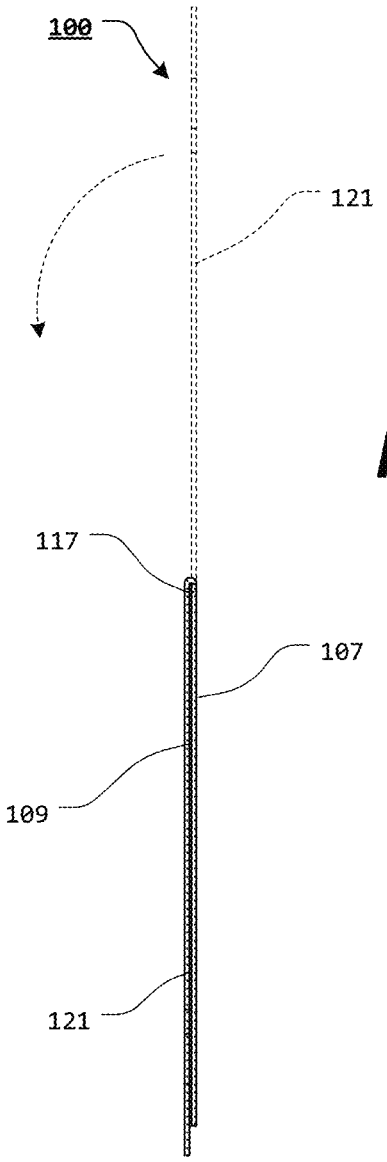
FIG. 2 illustrates a side view of an exemplary embodiment of an optional attachment interface panel of a multi-panel attachment system, wherein the accessory attachment element is folded to the rear side of the rear attachment interface portion, according to the present disclosure.
Figure 3:
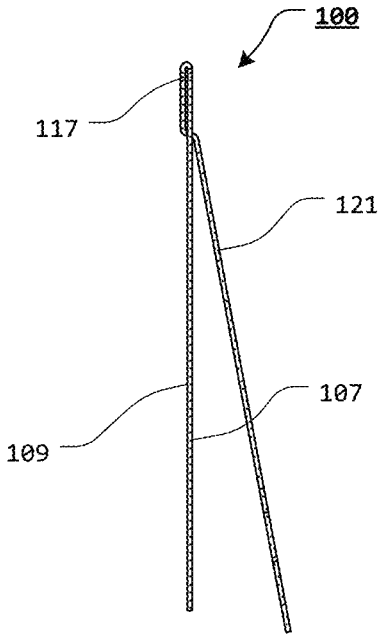
FIG. 3 illustrates a side view of an exemplary embodiment of an optional attachment interface panel of a multi-panel attachment system, wherein the accessory attachment element is folded to the rear side of the rear attachment interface portion and at least a terminating portion of the accessory attachment element is urged through an attachment slot of the rear attachment interface portion, according to the present disclosure.
Figure 4:
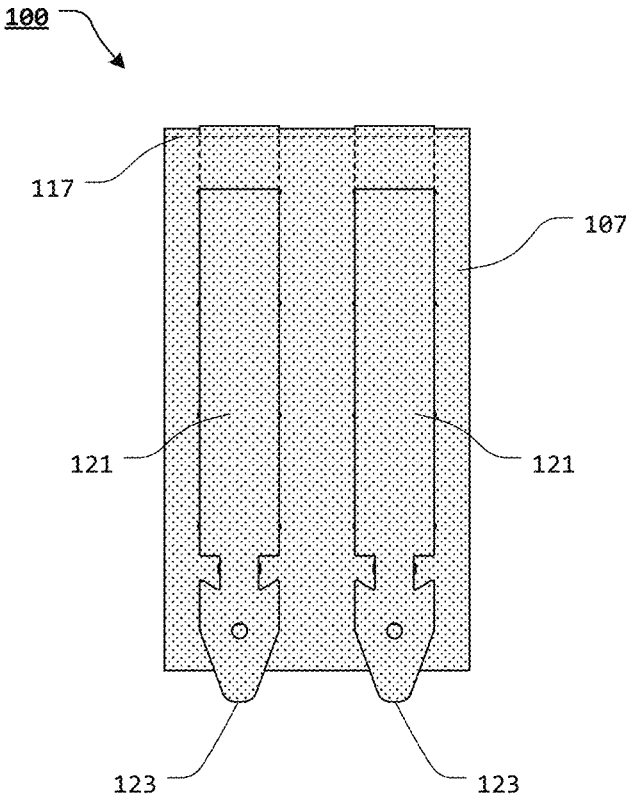
FIG. 4 illustrates a rear view of an exemplary embodiment of an optional attachment interface panel of a multi-panel attachment system, wherein the accessory attachment elements are folded to the rear side of the rear attachment interface portion and at least a terminating portion of the accessory attachment elements are urged through respective attachment slots of the rear attachment interface portion, according to the present disclosure.
Figure 5:
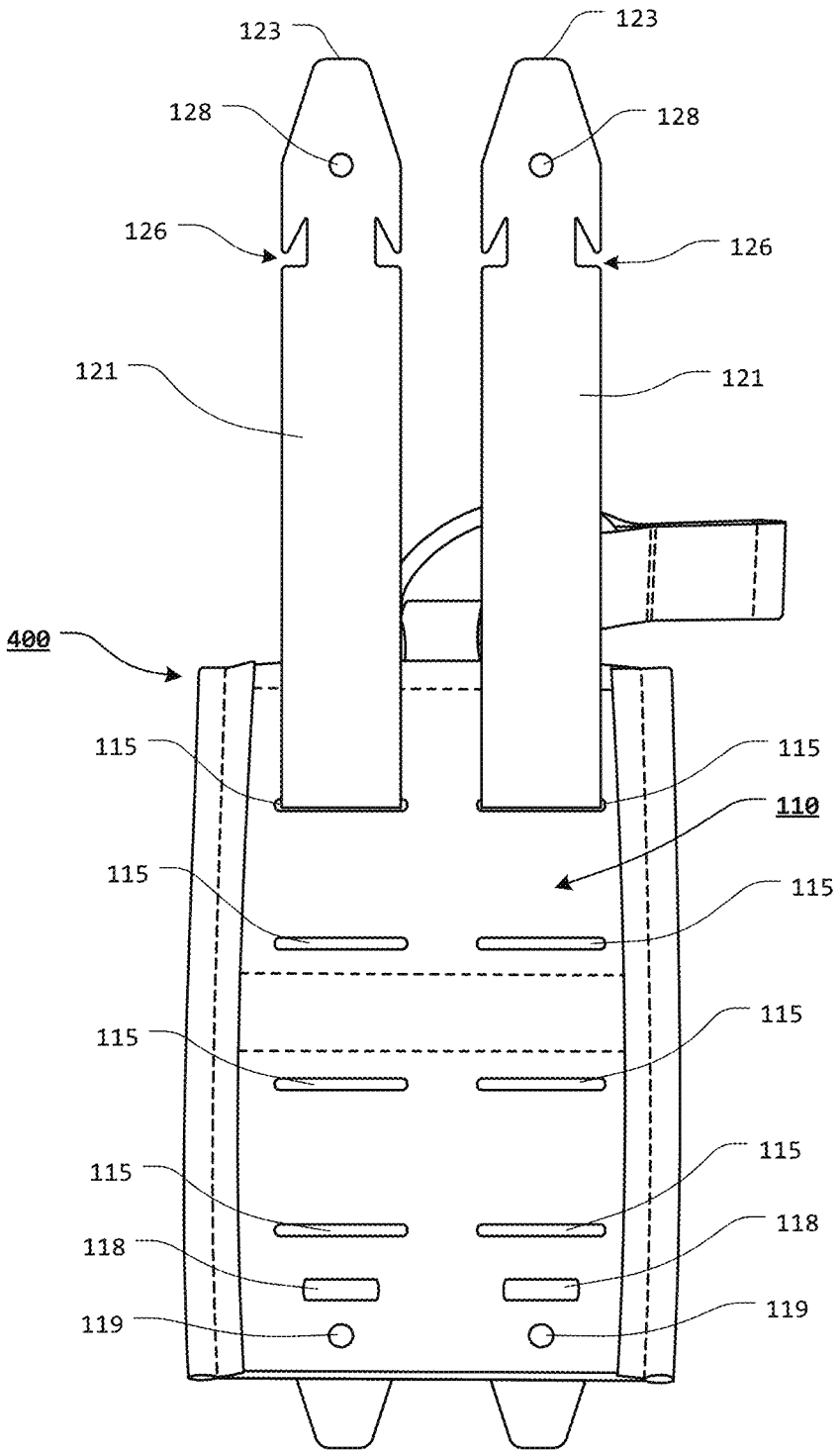
FIG. 5 illustrates a rear, perspective view of an exemplary embodiment of an optional attachment interface panel attached or coupled to an accessory of a multi-panel attachment system, according to the present disclosure.
Figure 6:
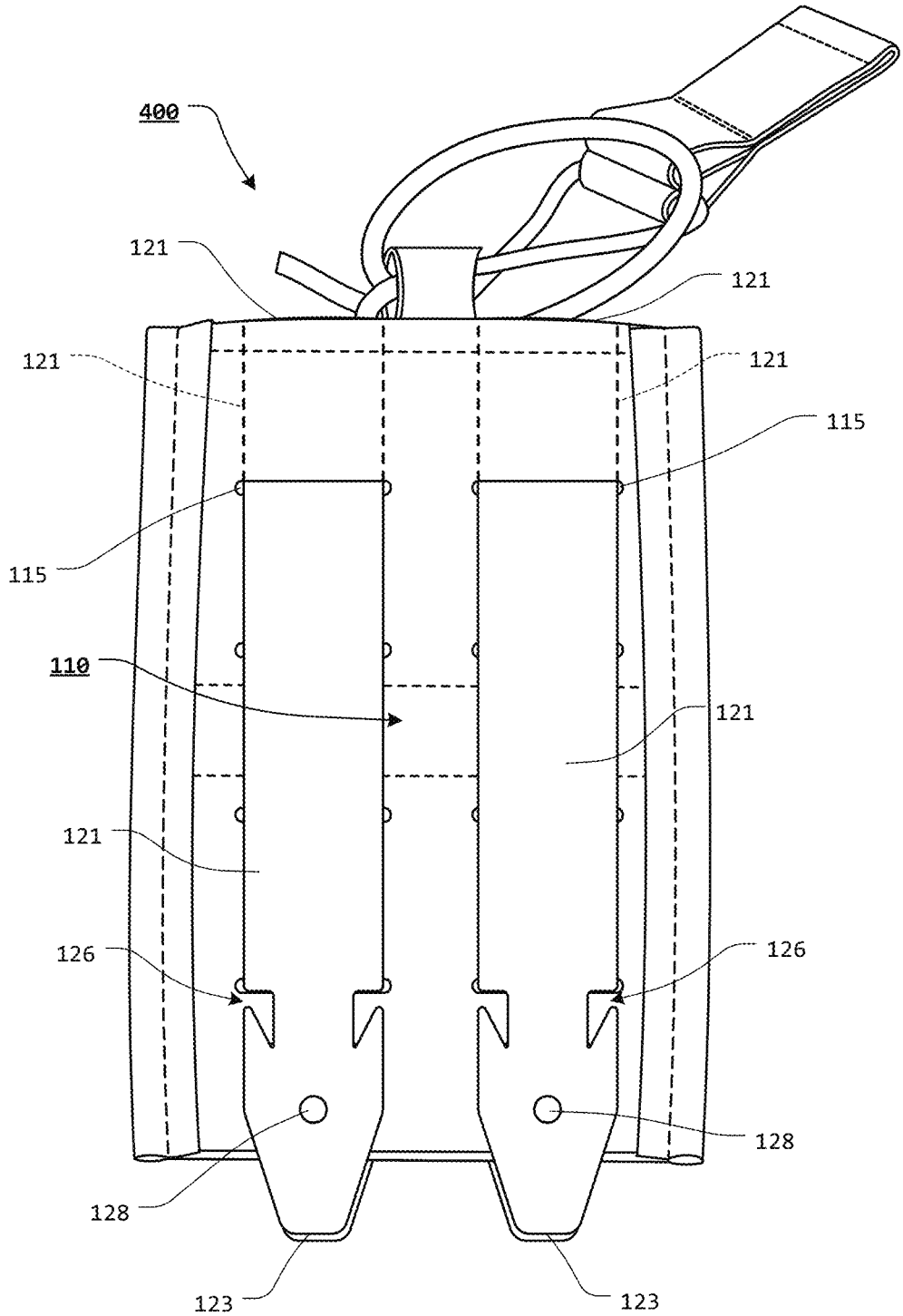
FIG. 6 illustrates a rear, perspective view of an exemplary embodiment of an optional attachment interface panel attached or coupled to an accessory of a multi-panel attachment system, wherein the multi-panel attachment system is attached or coupled to an exemplary accessory, according to the present disclosure.
Figure 7:
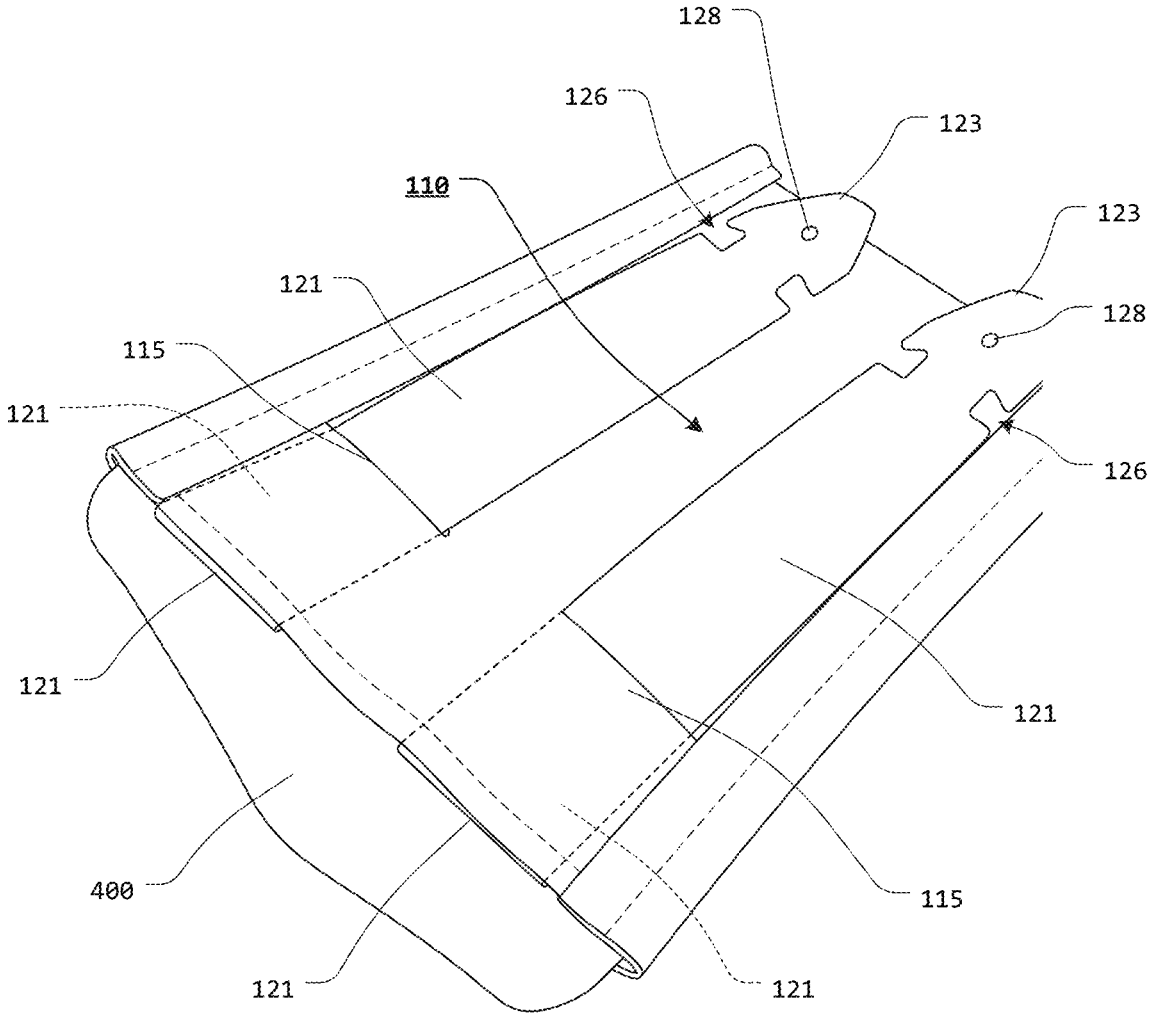
FIG. 7 illustrates an upper, rear, perspective view of certain exemplary components of an exemplary embodiment of a multi-panel attachment system, wherein the optional attachment interface panel is attached or coupled to an exemplary accessory, according to the present disclosure.

For simplicity and clarification, the design factors and operating principles of the multi-panel attachment system according to the present disclosure are explained with reference to various exemplary embodiments of a multi-panel attachment system according to the present disclosure. The basic explanation of the design factors and operating principles of the multi-panel attachment system is applicable for the understanding, design, and operation of the multi-panel attachment system of the present disclosure. It should be appreciated that the multi-panel attachment system can be adapted to many applications where a multi-panel attachment system can be used.

As used herein, the word "may" is meant to convey a permissive sense (i.e., meaning "having the potential to"), rather than a mandatory sense (i.e., meaning "must"). Unless stated otherwise, terms such as "first" and "second", "right" and "left", "top" and "bottom", "upper" and "lower", and "horizontal" and "vertical" are used to arbitrarily distinguish between the exemplary embodiments and/or elements such terms describe. Thus, these terms are not necessarily intended to indicate temporal or other prioritization of such exemplary embodiments and/or elements.

As used herein, and unless the context dictates otherwise, the term "coupled" is intended to include both direct coupling (in which two elements that are coupled to each other contact each other) and indirect coupling (in which at least one additional element is located between the two elements). The term coupled, as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

Furthermore, the terms "front", "rear", "right", "left", "upper", and "lower", as used in reference to the attachment interface and the rear attachment interface portion, are used for basic explanation and understanding of the operation of the presently disclosed systems, methods, and/or apparatuses and are to be seen as a naming convention used to help differentiate between certain of the components of the present disclosure and are not to be construed as limiting the systems, methods, and/or apparatuses of the present disclosure.

It should also be appreciated that the terms "multi-panel attachment system", "attachment interface", "attachment panel", "flap", and "accessory" are used for basic explanation and understanding of the operation of the systems, methods, and apparatuses of the present disclosure. Therefore, the terms "multi-panel attachment system", "attachment interface", "attachment panel", "flap", and "accessory" are not to be construed as limiting the systems, methods, and apparatuses of the present disclosure.

For simplicity and clarification, the multi-panel attachment system of the present disclosure will be shown and/or described as being used in conjunction with an exemplary accessory pouch being utilized as an exemplary accessory.

However, it should be appreciated that these are merely exemplary embodiments of the multi-panel attachment system and are not to be construed as limiting the present disclosure. Thus, the multi-panel attachment system of the present disclosure may be utilized in conjunction with any portion of a pouch, carrier, object, or device.

Figure 12:
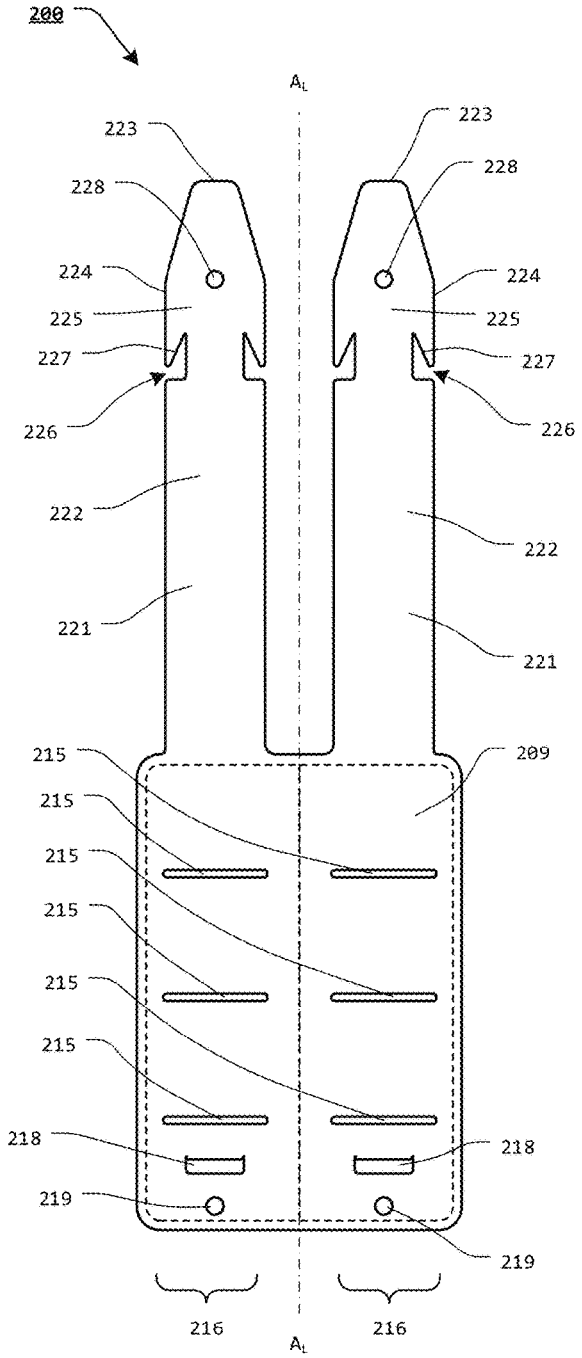
FIG. 12 illustrates a rear view of an exemplary embodiment of an attachment panel, according to the present disclosure.
Figure 13:
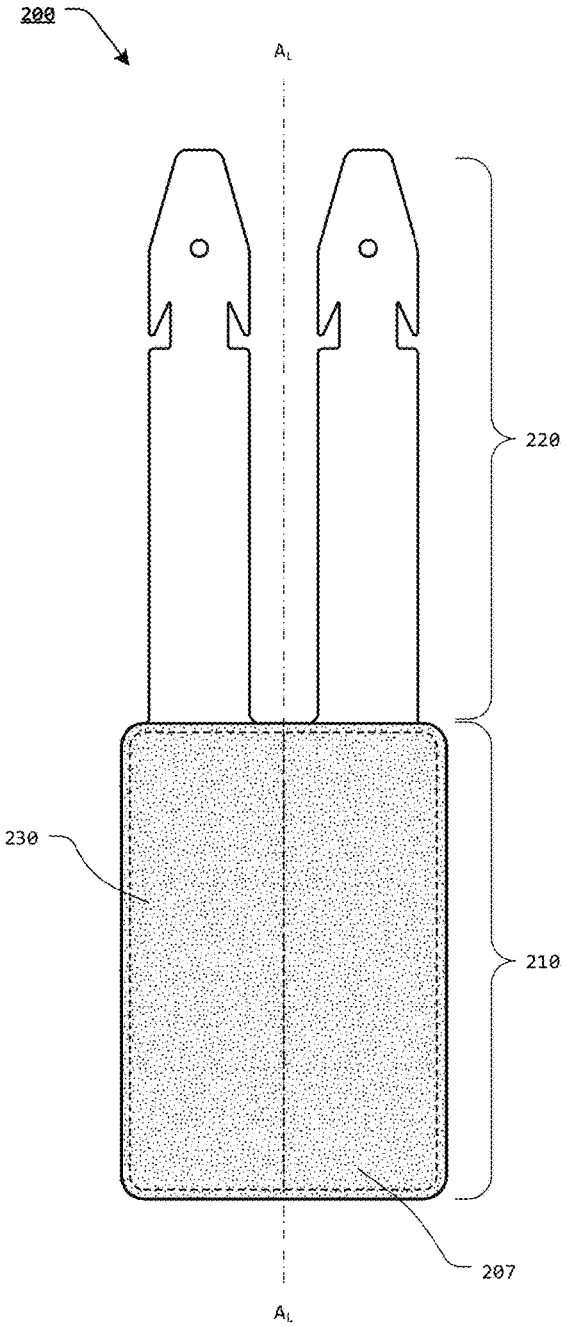
FIG. 13 illustrates a front view of an exemplary embodiment of an attachment panel, according to the present disclosure.
Figure 14:
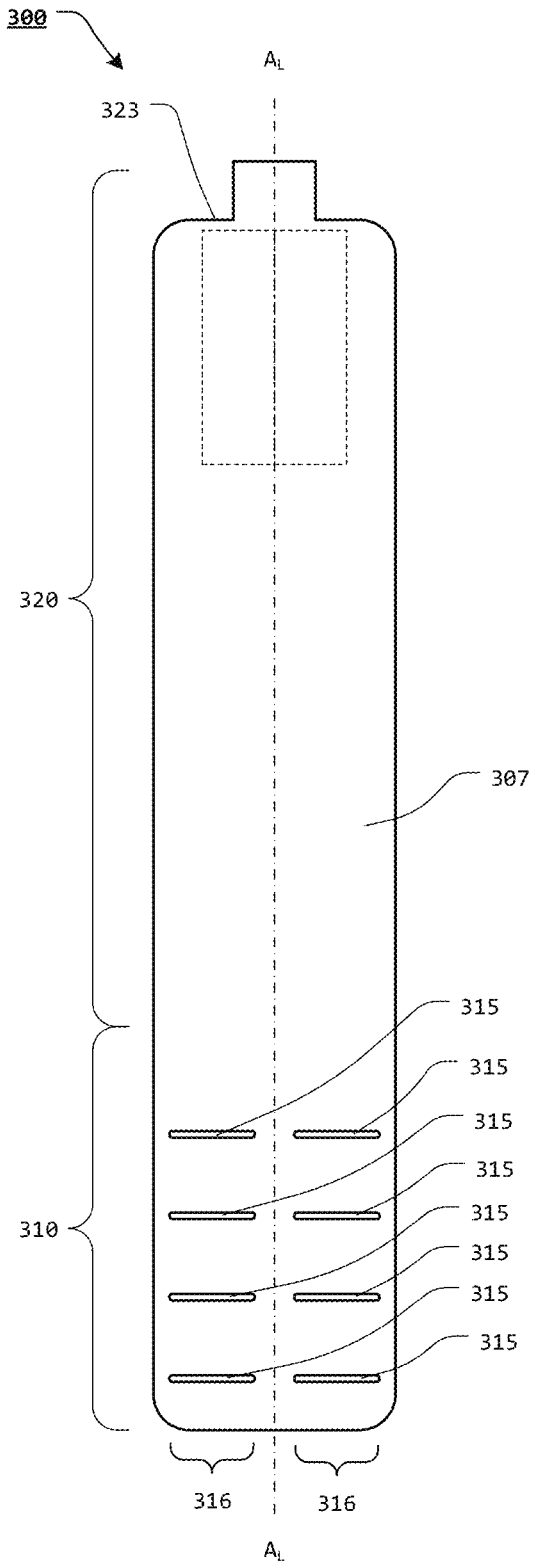
FIG. 14 illustrates a front view of an exemplary embodiment of a flap, according to the present disclosure.
Figure 15:
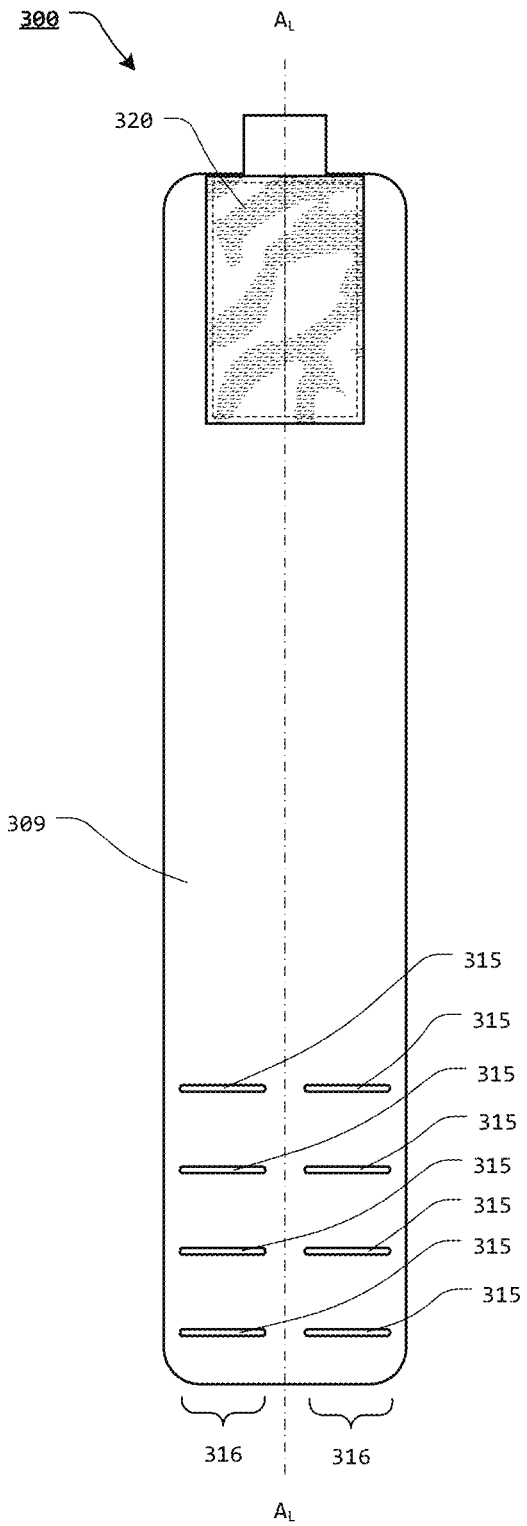
FIG. 15 illustrates a rear view of an exemplary embodiment of a flap, according to the present disclosure.
Figure 16:
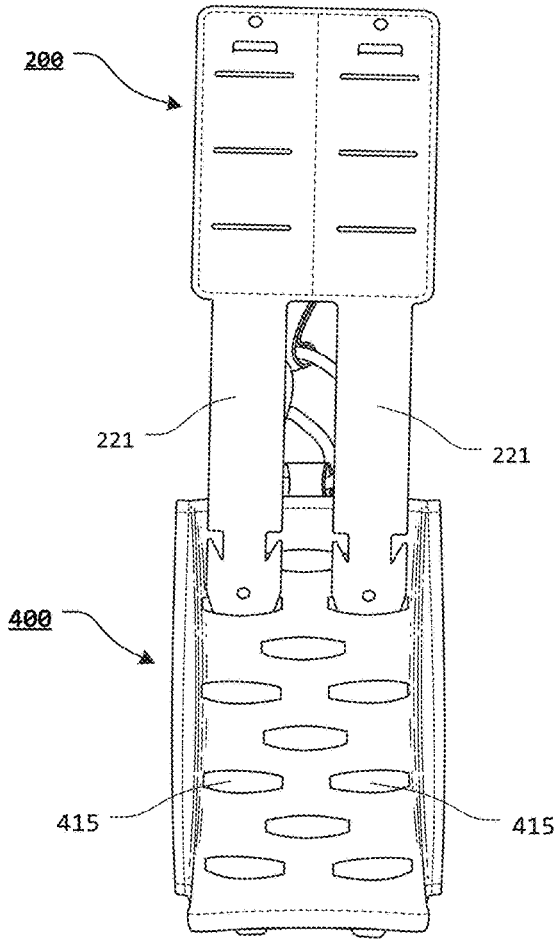
FIG. 16 illustrates a front view of an exemplary embodiment of an accessory, wherein an exemplary embodiment of an attachment panel is initially aligned with the accessory, according to the present disclosure.
Figure 17:
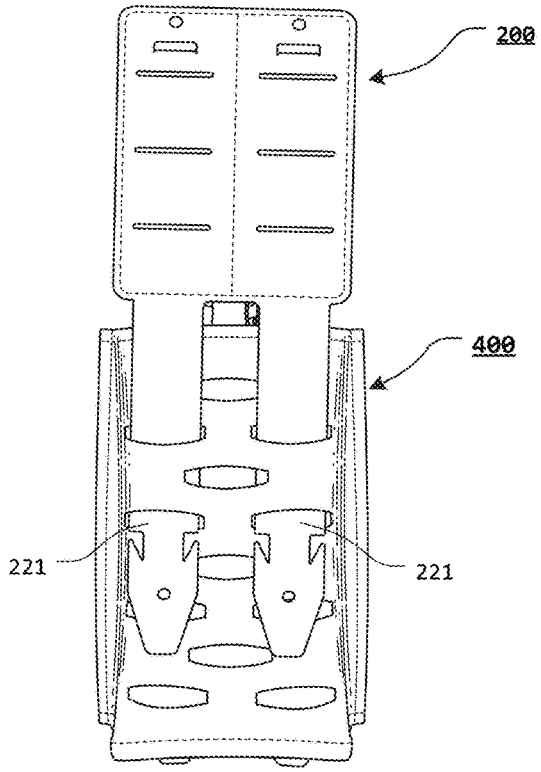
FIG. 17 illustrates a front view of an exemplary embodiment of an accessory, wherein an exemplary embodiment of an attachment panel is being releasably attached or coupled to the accessory, according to the present disclosure.
Figure 18:
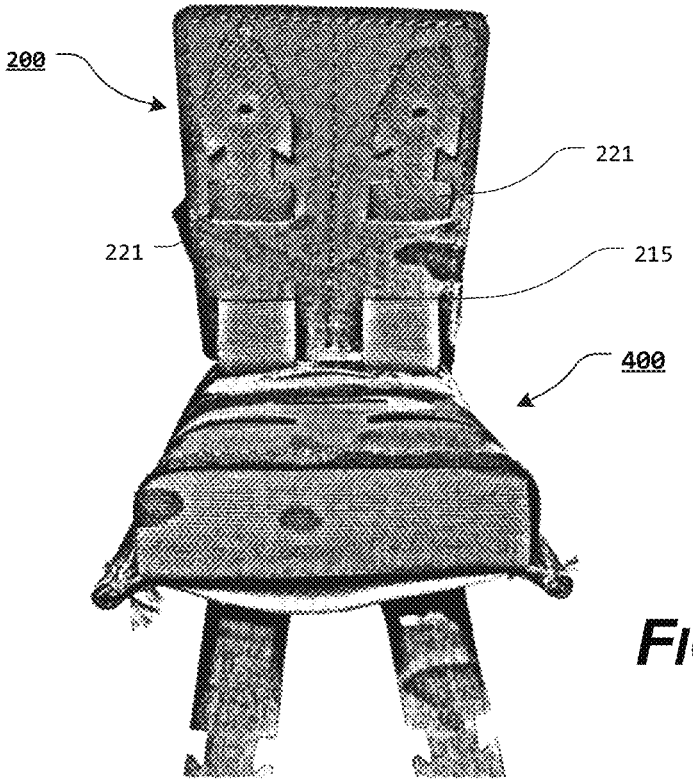
FIG. 18 illustrates a lower, front, perspective view of an exemplary embodiment of an accessory, wherein an exemplary embodiment of an attachment panel is being releasably attached or coupled to the accessory, according to the present disclosure.
Figure 19:
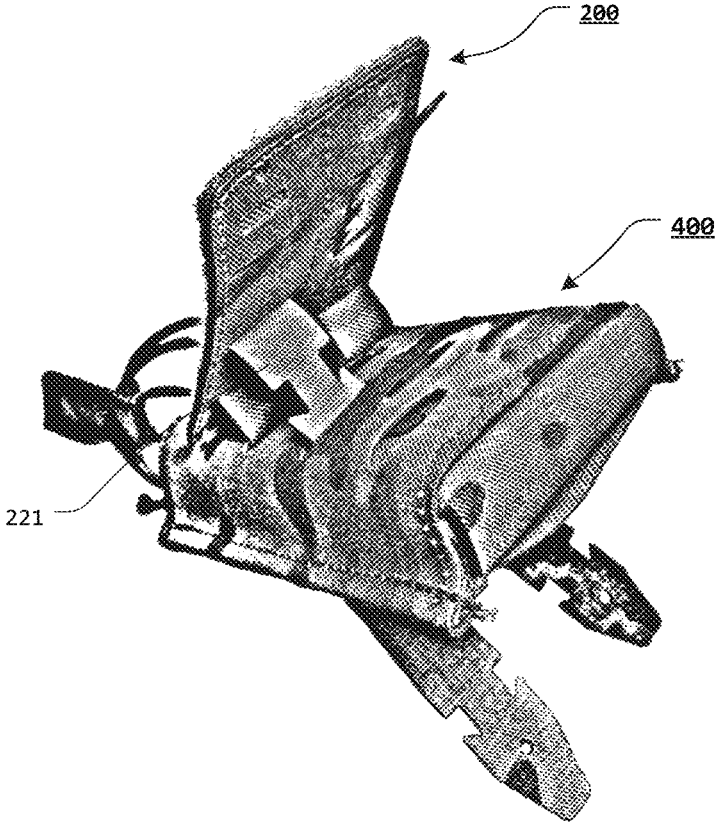
FIG. 19 illustrates a lower, side, perspective view of an exemplary embodiment of an accessory, wherein an exemplary embodiment of an attachment panel is being releasably attached or coupled to the accessory, according to the present disclosure.
Figure 20:
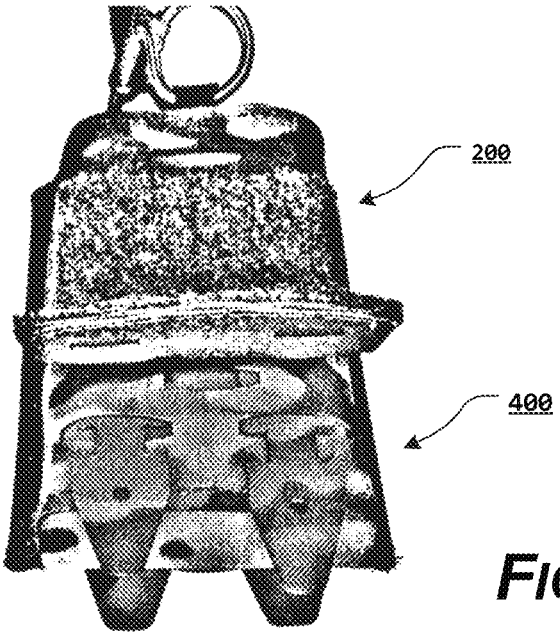
FIG. 20 illustrates a lower, front, perspective view of an exemplary embodiment of an accessory, wherein an exemplary embodiment of an attachment panel is being releasably attached or coupled to the accessory, according to the present disclosure.
Figure 21:
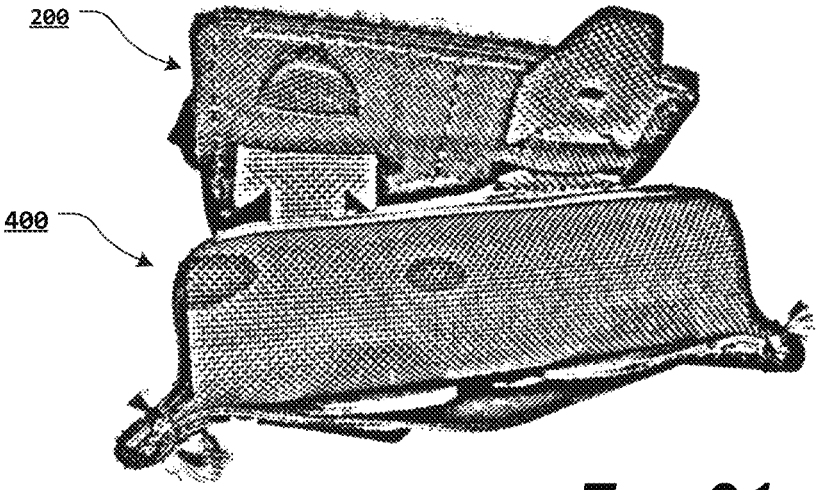
FIG. 21 illustrates a lower, front, perspective view of an exemplary embodiment of an accessory, wherein an exemplary embodiment of an attachment panel is being releasably attached or coupled to the accessory, according to the present disclosure.
Figure 22:
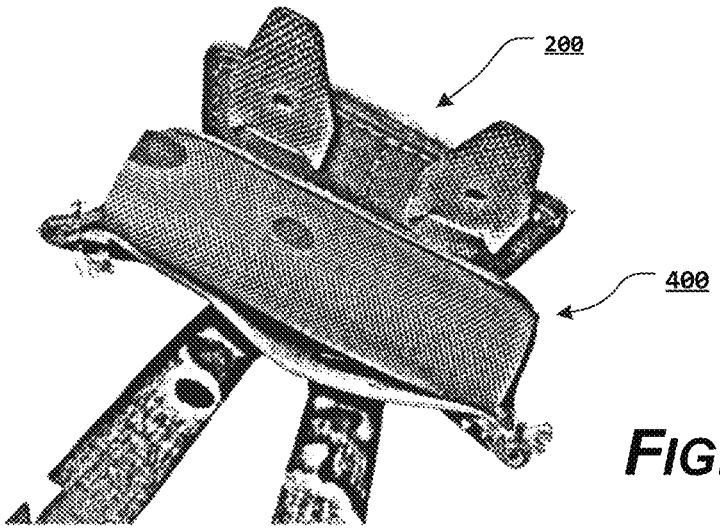
FIG. 22 illustrates a lower, front, perspective view of an exemplary embodiment of an accessory, wherein an exemplary embodiment of an attachment panel is releasably attached or coupled to the accessory, according to the present disclosure.
Figure 23:
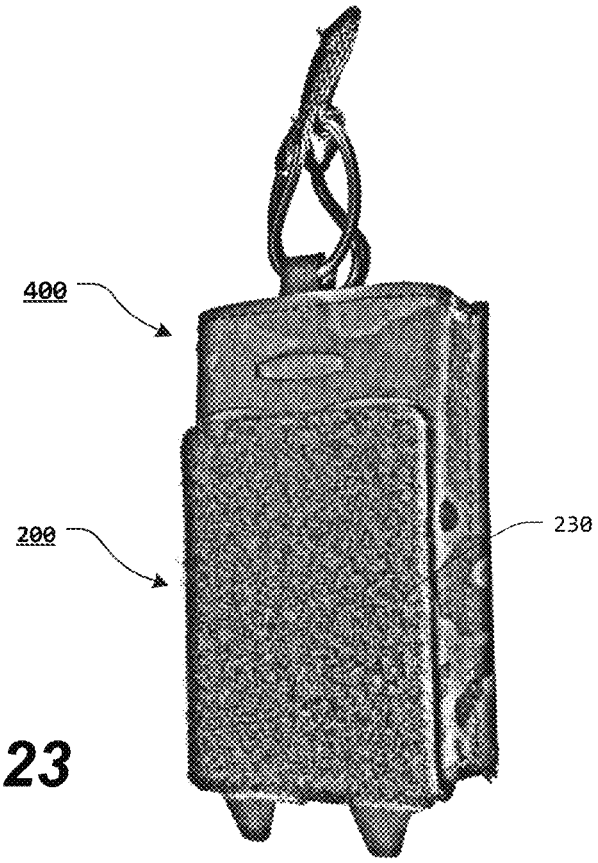
FIG. 23 illustrates a front, side perspective view of an exemplary embodiment of an accessory, wherein an exemplary embodiment of an attachment panel is releasably attached or coupled to the accessory, according to the present disclosure.
Figure 24:
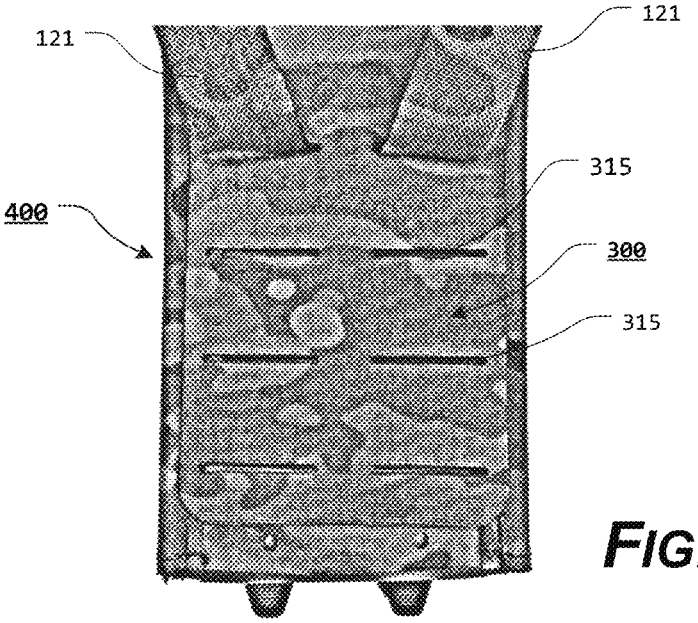
FIG. 24 illustrates a rear view of an exemplary embodiment of an accessory, wherein an exemplary embodiment of a flap is initially aligned with the accessory, according to the present disclosure.
Figure 25:
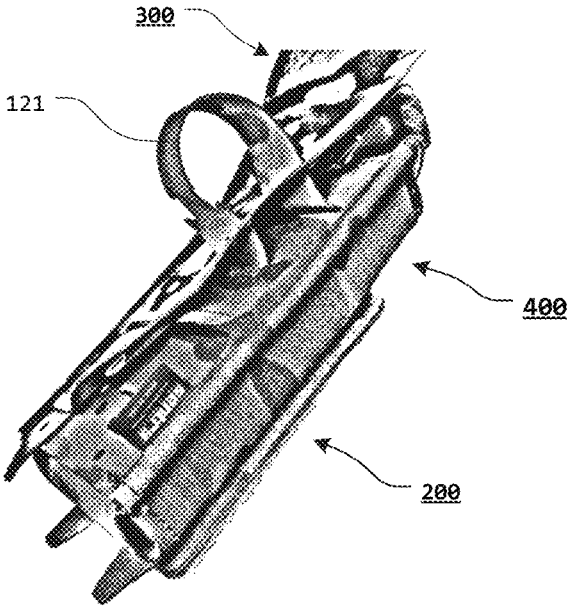
FIG. 25 illustrates a rear, side, perspective view of an exemplary embodiment of an accessory, wherein an exemplary embodiment of a flap is being releasably attached or coupled to the accessory, according to the present disclosure.
Figure 26:
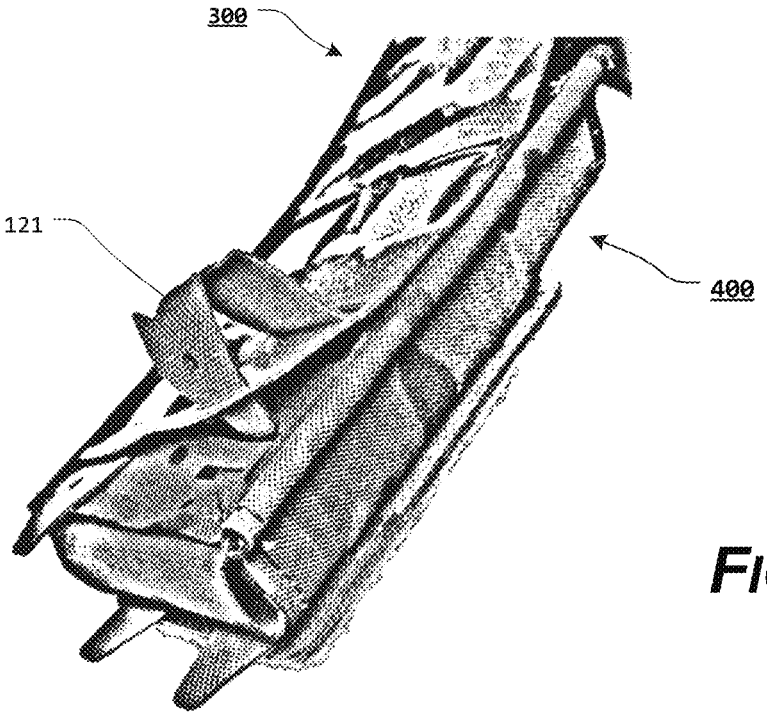
FIG. 26 illustrates a rear, side, perspective view of an exemplary embodiment of an accessory, wherein an exemplary embodiment of a flap is being releasably attached or coupled to the accessory, according to the present disclosure.
Figure 27:
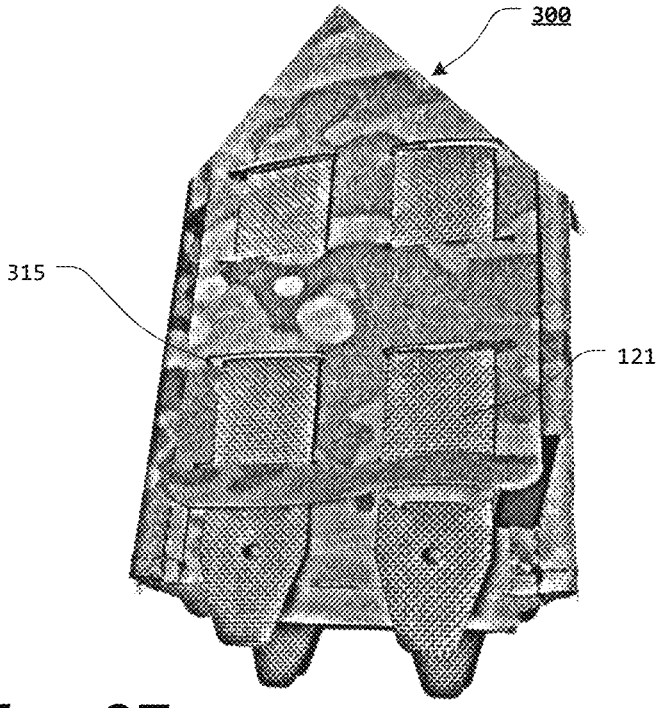
FIG. 27 illustrates a rear, perspective view of an exemplary embodiment of an accessory, wherein an exemplary embodiment of a flap is releasably attached or coupled to the accessory, according to the present disclosure.
Figure 28:
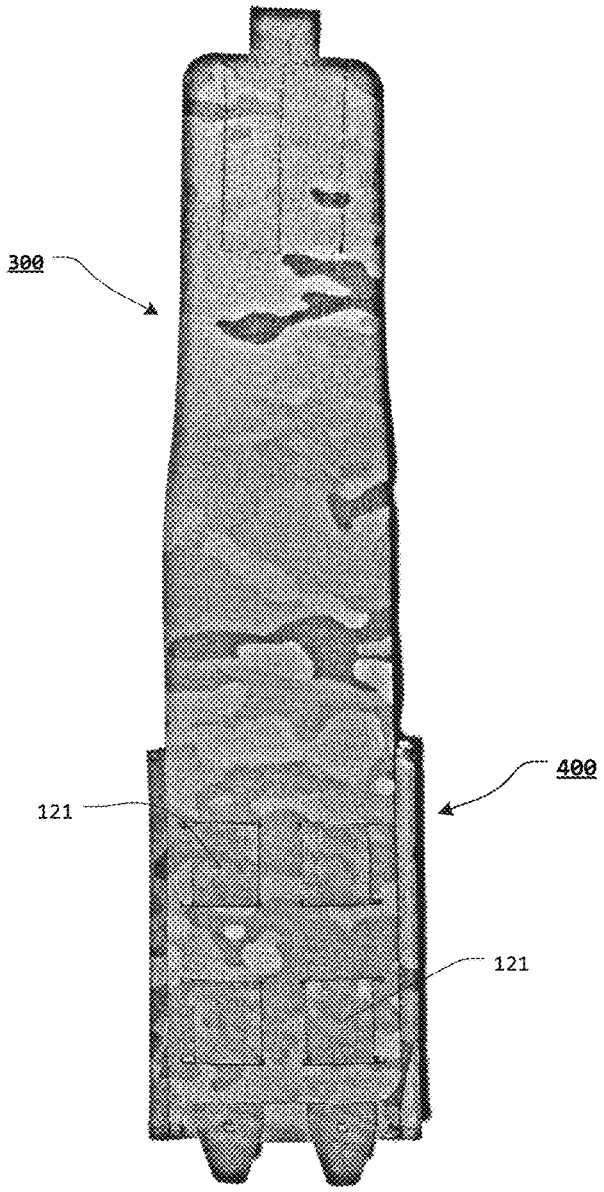
FIG. 28 illustrates a rear view of an exemplary embodiment of an accessory, wherein an exemplary embodiment of a flap is releasably attached or coupled to the accessory, according to the present disclosure.
Figure 29:
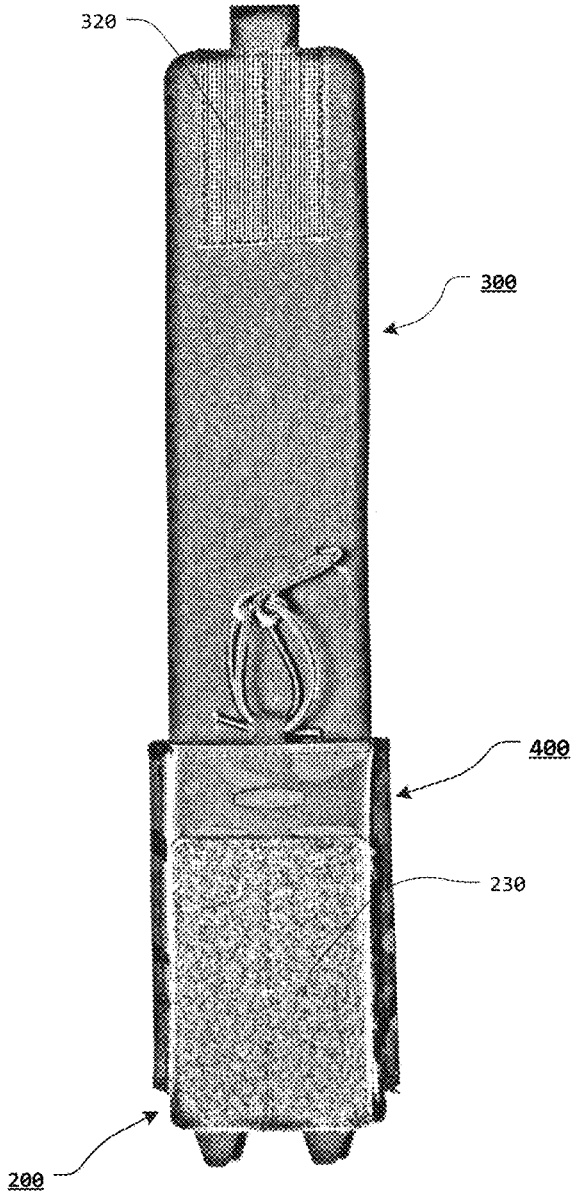
FIG. 29 illustrates a front view of an exemplary embodiment of an accessory, wherein an exemplary embodiment of a flap is releasably attached or coupled to the accessory and an exemplary embodiment of an attachment panel is releasably attached or coupled to the accessory, according to the present disclosure.
Figure 30:
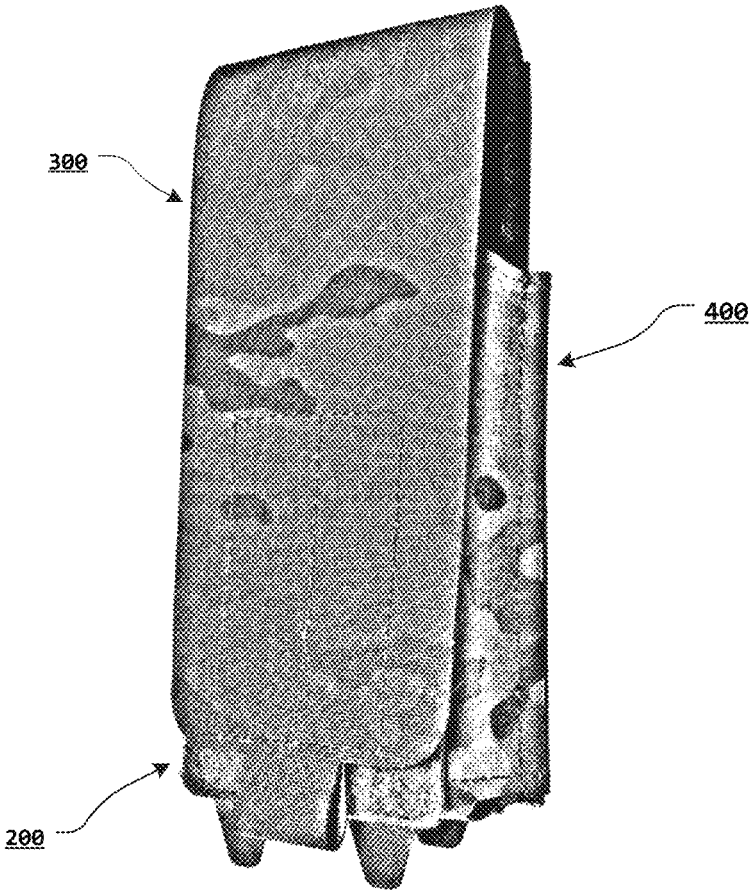
FIG. 30 illustrates a front, side, perspective view of an exemplary embodiment of an accessory, wherein an exemplary embodiment of a flap is releasably attached or coupled to the accessory and an exemplary embodiment of an attachment panel is releasably attached or coupled to the accessory, and wherein the flap is releasably attached or coupled to the attachment panel, according to the present disclosure.

Turning now to the appended drawing figures, FIGS. 1-11 illustrate certain elements and/or aspects of an exemplary embodiment of an attachment interface panel 100 that may optionally be utilized with an embodiment of the multi-panel attachment system, according to the present disclosure. FIGS. 12-13 illustrate certain elements and/or aspects of an exemplary embodiment of an attachment panel 200, while FIGS. 14-15 illustrate certain elements and/or aspects of an exemplary embodiment of a flap panel 300, according to the present disclosure. FIGS. 16-30 illustrate optional attachment or coupling of the attachment panel 200 and/or flap panel 300 to the accessory 400, according to certain exemplary embodiments of the present disclosure.

The accessory 400 may be formed of any size or shape.

In various exemplary embodiments, a bungee retention tab 454 extends from one or more top edges of the accessory 400. The bungee retention tab(s) 454 allow a portion of bungee cord 456 to be attached or coupled to the accessory 400, for further securing an item within the cavity 452 of the accessory 400. The bungee retention tab(s) 454, if included, may optionally extend as an integral portion of the accessory 400.

In certain illustrative, non-limiting embodiment(s) of the presently disclosed systems, methods, and/or apparatuses, as illustrated in FIGS. 1-11, the accessory 400 comprises at least one attachment interface panel 100 having an attachment front side 107 and an opposing attachment rear side 109. The attachment interface panel 100 includes an attachment interface portion 110 and an accessory attachment portion 120 formed as integral components of the attachment interface panel 100.

One or more accessory attachment elements 121 extend as an integral extension of a portion of the attachment interface portion 110 to form the accessory attachment portion 120. Each accessory attachment element 121 includes an attachment extension portion 122 that extends from the attachment interface portion 110. The attachment extension portion 122 extends to a terminating portion 125 having a terminal end 123. Each attachment extension portion 122 generally extends parallel to a longitudinal axis, $A_L$, of the attachment interface panel 100. Thus, instead of being formed of a separate material or separate portion of material that is attached or coupled to the attachment interface portion 110, each accessory attachment element 121 extends as a continuation of the material used to form the attachment interface portion 110 of the attachment interface panel 100.

It should be appreciated that the attachment interface panel 100 may be formed so as to include a single accessory attachment element 121 extending from the attachment interface portion 110 and including a single interface column 116 of accessory attachment slots 115 and at least one locking slot 118 and optional interface portion locking aperture 119. Alternatively, the attachment interface panel 100 may include 2 or more accessory attachment elements 121 extending from the attachment interface portion 110 and a corresponding interface column 116 of accessory attachment slots 115 and at least one locking slot 118 and optional interface portion locking aperture 119 for each accessory attachment element 121.

Attachment element notches 126 are defined by recesses formed in opposing side portions of each accessory attachment element 121, between the attachment extension portion 122 and a terminating portion 125 of each accessory attachment element 121. The attachment element notches 126 define portions of the accessory attachment element 121 with a reduced width, when compared to the widths of the attachment extension portion 122 and the terminating portion 125.

Each attachment element notch 126 defines a shoulder 127, proximate the terminating portion 125. In various exemplary embodiments, the shoulder 127 is optionally formed substantially perpendicular to a longitudinal axis, $A_L$, of the accessory attachment element 121. Alternatively, the shoulder 127 is optionally formed at an acute or obtuse angle relative to the longitudinal axis, $A_L$, of the accessory attachment element 121. In these exemplary embodiments, the angle of the shoulder 127 allows the terminating portion 125 to be more firmly held within a locking slot 118.

A wing portion 124 extends from the shoulder 127 of each attachment element notch 126, toward the terminal end 123 of the accessory attachment element 121, within the terminating portion 125 of the accessory attachment element 121. In various exemplary embodiments, a width of the wing portion 124, proximate the shoulder 127, is the same or substantially the same as the width of the attachment extension portion 122 of the accessory attachment element 121. The width of the wing portion 124 may optionally taper as the wing portion 124 extends from the shoulder 127 or proximate the shoulder 127 to the terminal end 123.

An attachment element locking aperture 128 may optionally be formed through a portion of the accessory attachment element 121, within the terminating portion 125, proximate the terminal end 123. If included, the attachment element locking aperture 128 may be utilized to further assist in securing the accessory attachment element 121 to the attachment interface portion 110 by allowing a portion of material to be positioned through the attachment element locking aperture 128 and the interface portion locking aperture 119 of the attachment interface portion 110.

The attachment interface portion 110 is formed so as to include a plurality of spaced apart accessory attachment slots 115 formed therethrough. In various exemplary embodiments, the accessory attachment slots 115 are generally formed as slots or apertures through the attachment interface portion 110. Each accessory attachment slot 115 is defined by one or more continuous edges.

The attachment interface portion 110 of the present disclosure is operable with as few as two accessory attachment slots 115. Thus, the size and shape of the attachment interface portion 110 is a design choice, based upon, for example, the size and shape of the portion of attachment interface portion 110 that is desired to potentially accept attachment or coupling of accessory attachment element(s) 121.

In various exemplary embodiments, the size of each accessory attachment slot 115 is influenced or dictated by the width of the accessory attachment element(s) 121. For example, if an accessory attachment element 121 has a width of approximately 1 inch, the width of the accessory attachment slots 115 may optionally be slightly greater than approximately 1 inch, so as to allow the accessory attachment element(s) 121 to be appropriately positioned through the accessory attachment slots 115. It should be appreciated that the size and shape of each of the accessory attachment slots 115 is a design choice based upon the desired functionality and/or appearance of the attachment interface portion 110 and the ability of each accessory attachment slot 115 to allow at least a portion of an accessory attachment element 121 to pass therethrough without undue or excess movement or play within each accessory attachment slot 115.

The accessory attachment slots 115 are arranged in a repeating or semi-repeating series or sequence of spaced apart, repeating patterns. In various exemplary embodiments, the accessory attachment slots 115 are arranged in an interface column 116. The longitudinal axis, $A_L$, of the interface column 116 is parallel to the longitudinal axis, $A_L$, of each accessory attachment element 121.

It should be appreciated that two or more adjacent accessory attachment slots 115 may comprise a row and two or more adjacent accessory attachment slots 115 may comprise an interface column 116. Thus, it should be appreciated that the number of accessory attachment slots 115 formed in the attachment interface portion 110 is a design choice based upon the desired size and/or functionality of the attachment interface portion 110.

By arranging the accessory attachment slots 115 in a repeating or semi-repeating series or sequence, tunnel segments are created between adjacent accessory attachment slots 115 (typically along a longitudinal axis, $A_L$, of an interface column 116).

One or more locking slots 118 are also formed within the interface column 116 of accessory attachment slots 115. A width of each locking slot 118 generally corresponds to a width of the accessory attachment element 121 between opposing attachment element notches 126 of a given accessory attachment element 121. The locking slot 118 is typically formed proximate a location where the attachment element notches 126 will be located when the accessory attachment element 121 is folded over the attachment interface panel 100.

In certain exemplary embodiments, an interface portion locking aperture 119 is also formed proximate each locking slot 118. Each interface portion locking aperture 119 is formed proximate a location where each attachment element locking aperture 128 will desirably be positioned when the attachment element notches 126 are positioned within the locking slots 118. Alignment of the interface portion locking aperture 119 with the attachment element locking aperture 128 allows an additional fastening element to be positioned through the aligned attachment element locking aperture 128 and interface portion locking aperture 119 to further secure the terminating portion 125 of the accessory attachment element 121 to the attachment interface portion 110.

In certain exemplary embodiments, the attachment interface panel 100 is formed of a portion of a fabric-type or other material, such as, for example, chlorosulfonated polyethylene (CSPE) synthetic rubber (CSM). In certain exemplary embodiments, the attachment interface panel 100 is formed of a portion of Hypalon fabric. However, the present disclosure is not so limited. For example, in certain exemplary embodiments, the attachment interface panel 100 may be formed of a rigid material, a semi-rigid material, or a substantially flexible material.

In various exemplary, non-limiting embodiments, all or portions of the attachment interface panel 100 may be made of any fabric or other material, such as, for example, interwoven fabrics, canvas, acrylics, sheet fabrics, films, nylon, spandex, vinyl, Polyvinyl Chloride (PVC), neoprene, or the like. Alternatively, all or portions of the attachment interface panel 100 may be formed from multiple, similar or dissimilar materials. In various exemplary, non-limiting embodiments, the attachment interface panel 100 may be water-resistant or may include a cushion material.

It should be appreciated that the terms fabric and material are to be given their broadest meanings and that the particular fabric(s) or material(s) used to form the attachment interface panel 100 is a design choice based on the desired appearance and/or functionality of the attachment interface panel 100. In general, the material used to form the attachment interface panel 100 is selected for its ability to allow the accessory attachment element(s) 121 to be appropriately interwoven between the accessory attachment slots 115 of the attachment interface portion 110.

While the attachment interface portion 110 is illustrated as comprising a somewhat rectangular portion of material, it should be appreciated that the overall size and shape of the attachment interface portion 110 is a design choice based upon the desired appearance and/or functionality of the attachment interface panel 100 and/or the size and/or shape of the accessory 400 to which the attachment interface panel 100 is to be attached or coupled.

The attachment interface panel 100 may be at least partially attached or coupled to a portion of the accessory 400. As illustrated most clearly in FIGS. 5-7, the attachment interface portion 110 may optionally be attached or coupled to a portion of the accessory 400 by attachment elements, such as stitching 432 proximate a perimeter of the attachment interface portion 110 and a perimeter of the portion of the accessory 400.

In certain exemplary embodiments, the stitching 117 utilized to position the accessory attachment elements 121 relative to the attachment interface portion 110 is the stitching 117 utilized to attach or couple the attachment interface portion 110 to the accessory 400.

In certain exemplary embodiments, the attachment elements comprise stitching 117. Alternatively, the attachment interface portion 110 may be attached or coupled to the accessory 400 via adhesive bonding, welding, screws, rivets, pins, mating hook and loop portions, snap or releasable fasteners, or other known or later developed means or methods for permanently or releasably attaching or coupling the attachment interface portion 110 to the accessory 400.

In addition to the variability of size and shape of the attachment interface portion 110, the orientation of the attachment interface portion 110, relative to the accessory 400, is also a design choice. Thus, while the attachment interface portion 110 is illustrated as being attached or coupled to the accessory 400, such that the interface columns 116 of accessory attachment slots 115 are substantially parallel to the longitudinal axis, $A_L$, along the length, of the accessory 400, it should be appreciated that this is merely exemplary and the attachment interface portion 110 may be attached at any desired angular or rotational orientation relative to the accessory 400.

The portions of material of the attachment interface portion 110 between adjacent accessory attachment slots 115 form tunnel segments. If the attachment interface portion 110 is attached to an accessory 400, the tunnel segments are formed between the attachment interface portion 110 and the surface of the accessory 400. The tunnel segments provide areas for securing the accessory attachment element(s) 121 to the attachment interface portion 110. In this manner, an accessory attachment element 121 may be interwoven between the aligned tunnel segments to removably attach the accessory 400 to a portion of MOLLE webbing, slots, or other features of an article of clothing, a vest, a plate carrier, a backpack, a pack, a platform, and other carrier or device to which the accessory 400 is to be attached.

A more detailed explanation of the instructions regarding how to interweave the accessory attachment element 121 between the accessory attachment slots 115 and attachment elements of the device to which the accessory 400 is to be attached or coupled is not provided herein because accessories incorporating the attachment interface panel 100 of the present disclosure are generally attached or coupled to the device to which the accessory 400 is to be attached or coupled in a manner similar to the manner in which accessories are attached or coupled to a portion of MOLLE webbing. Therefore, it is believed that the level of description provided herein is sufficient to enable one of ordinary skill in the art to understand and practice the systems, methods, and apparatuses, as described.

Figure 8:
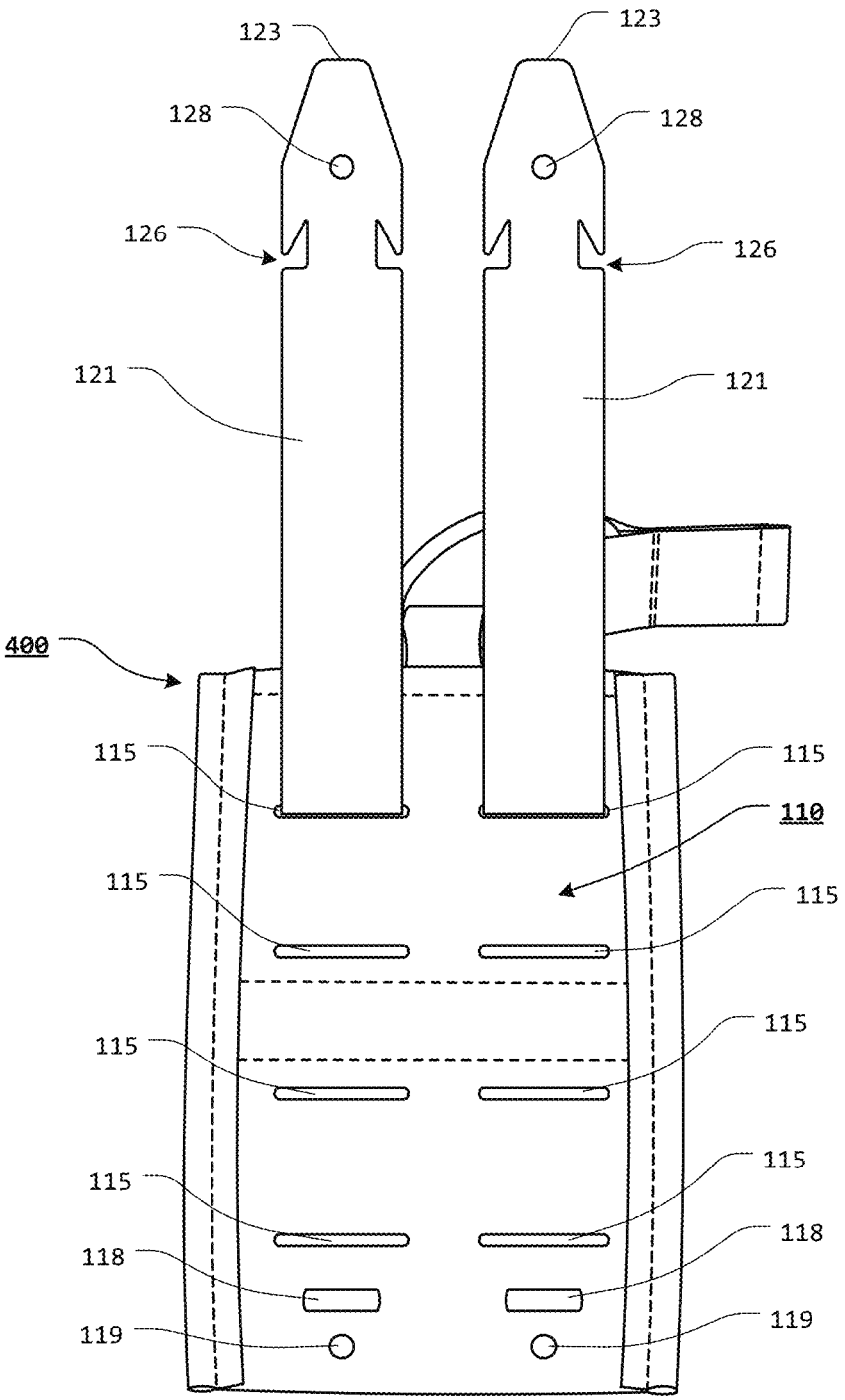
FIG. 8 illustrates a rear, perspective view of an exemplary embodiment of an optional attachment interface panel formed as a rear wall of an accessory of a multi-panel attachment system, according to the present disclosure.
Figure 9:
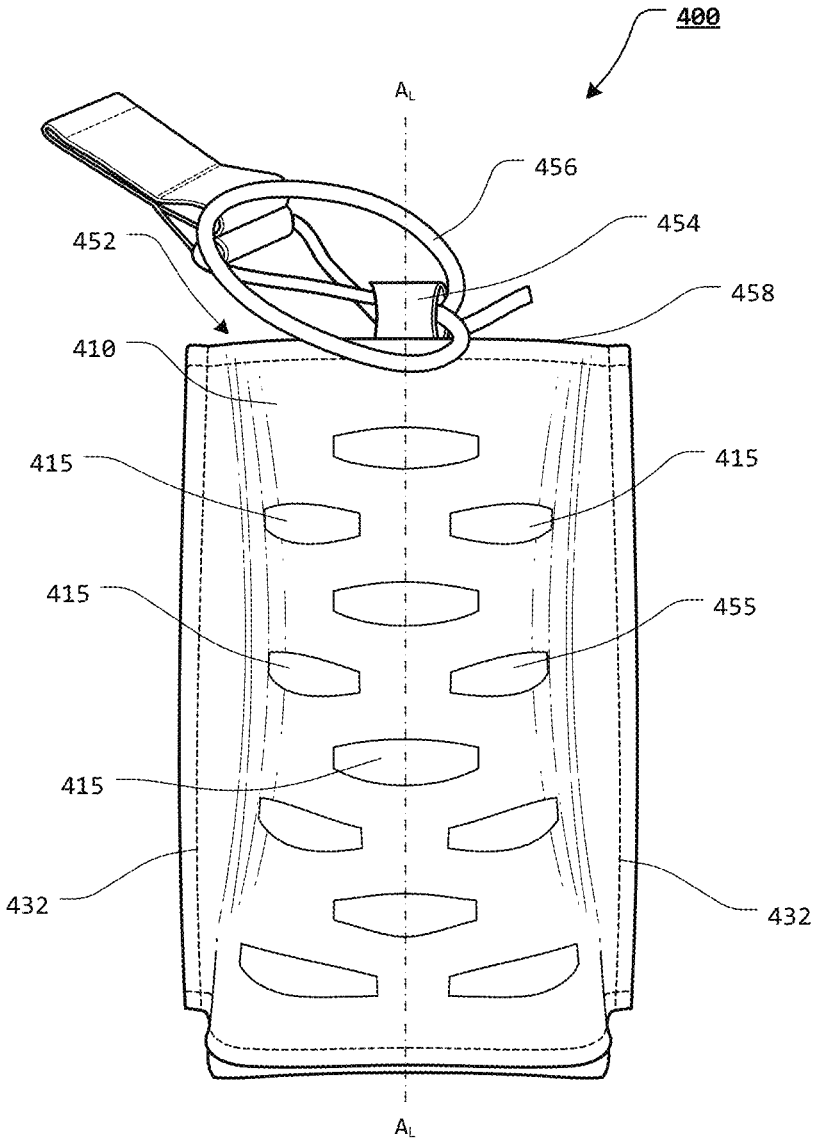
FIG. 9 illustrates a front view of an exemplary embodiment of an accessory for use in certain exemplary embodiments of a multi-panel attachment system, according to the present disclosure.

It should be appreciated that while the attachment interface panel 100 is optionally described as being a separate element that is attached or coupled to a rear portion of an accessory 400, the attachment interface panel 100 is not so limited. For example, as illustrated in FIG. 8, the attachment interface panel 100 may comprise an integral portion of an accessory 400, which forms an outer rear portion or outer rear wall of the accessory 400.

The accessory 400 includes a front attachment interface portion 410 that forms an outer front portion or outer front wall of the accessory 400. In various exemplary embodiments, a plurality of accessory apertures 415 are formed through at least a portion of the front attachment interface portion 410 at spaced apart locations and arranged in one or more rows and/or columns, such that tunnel segments are formed between adjacent accessory apertures 415. In certain exemplary embodiments, as few as two accessory apertures 415 are included. It should be appreciated that the number, size, shape, and arrangement of any accessory apertures 415 is a design choice based upon the size and shape of the front attachment interface portion 410 or portion of the front attachment interface portion 410 that is desired to potentially accept attachment or coupling of additional accessories.

Figure 10:
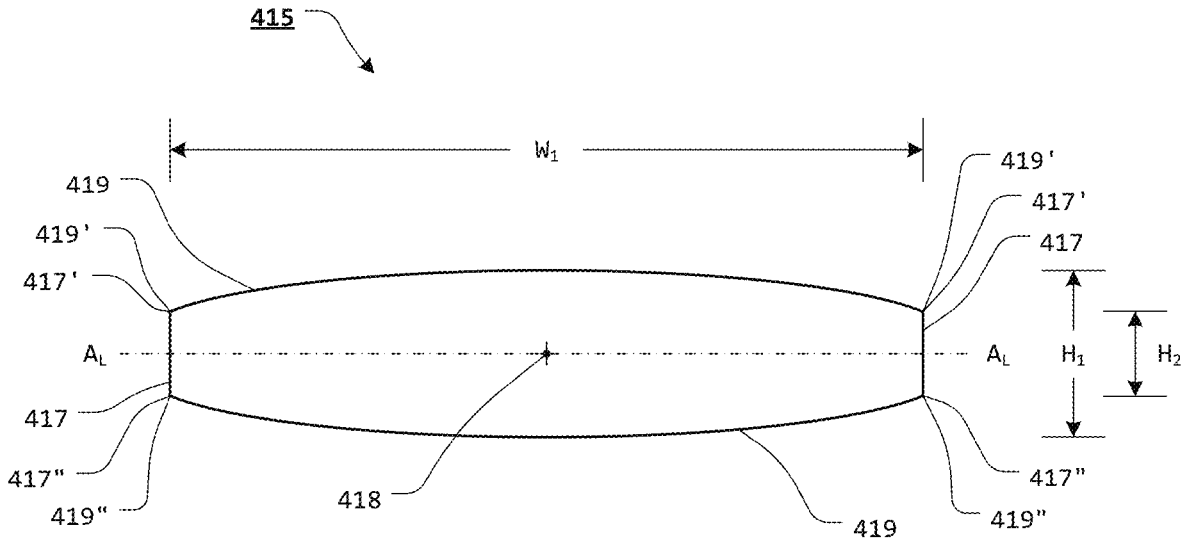
FIG. 10 illustrates a front view of an exemplary embodiment of an attachment aperture according to the present disclosure.

In various exemplary embodiments, as illustrated most clearly in FIG. 10, each accessory aperture 415 may optionally be defined by one or more continuous edges or edge portions and is defined by a first height, H1, a second height, H2, and a first width, W1. In various exemplary embodiments, each accessory aperture 415 is formed of two substantially equal length, parallel sides 417. Each parallel side 417 extends from an upper terminal end 417' to a lower terminal end 417" and has a length or height, H2. It should be appreciated that the width, W1, between of each of the parallel sides 417 is a design choice based upon the desired functionality and/or appearance of the accessory aperture 415.

An arcuate side 419 joins respective upper terminal ends 417' and respective lower terminal ends 417" of each of the parallel sides 417. Each arcuate side 419 extends from a first terminal end 419' to a second terminal end 419".

In various exemplary embodiments, the height, H1, is formed between apexes of each of the parallel sides 417. It should be appreciated that the height, H1, between apexes of each of the parallel sides 417 is a design choice based upon the desired functionality and/or appearance of the accessory aperture 415. Thus, the angle of each arc forming each arcuate side 419 may be formed based upon the desired functionality and/or appearance of each accessory aperture 415.

Each accessory aperture 415 is generally formed as an aperture or hole through the front attachment interface portion 410 of the front attachment interface portion 410 of the accessory 400. However, in various exemplary embodiments, one or more accessory apertures 415 may be formed through the rear pouch panel.

The overall size of each accessory aperture 415 is also a design choice. In certain exemplary embodiments, the size of each accessory aperture 415 is influenced or dictated by the width of the accessory 400 coupling element of a compatible accessory 400. For example, if the accessory 400 coupling element has a width of approximately 1 inch, the width, W1, between of each of the parallel sides 417 may optionally be approximately 1 inch, so as to allow the accessory 400 coupling element to be fitted within and interwoven between two or more accessory apertures 415. Alternatively, the width, W1, between of each of the parallel sides 417 may be such that only certain accessories are compatible with the accessory apertures 415.

Figure 11:
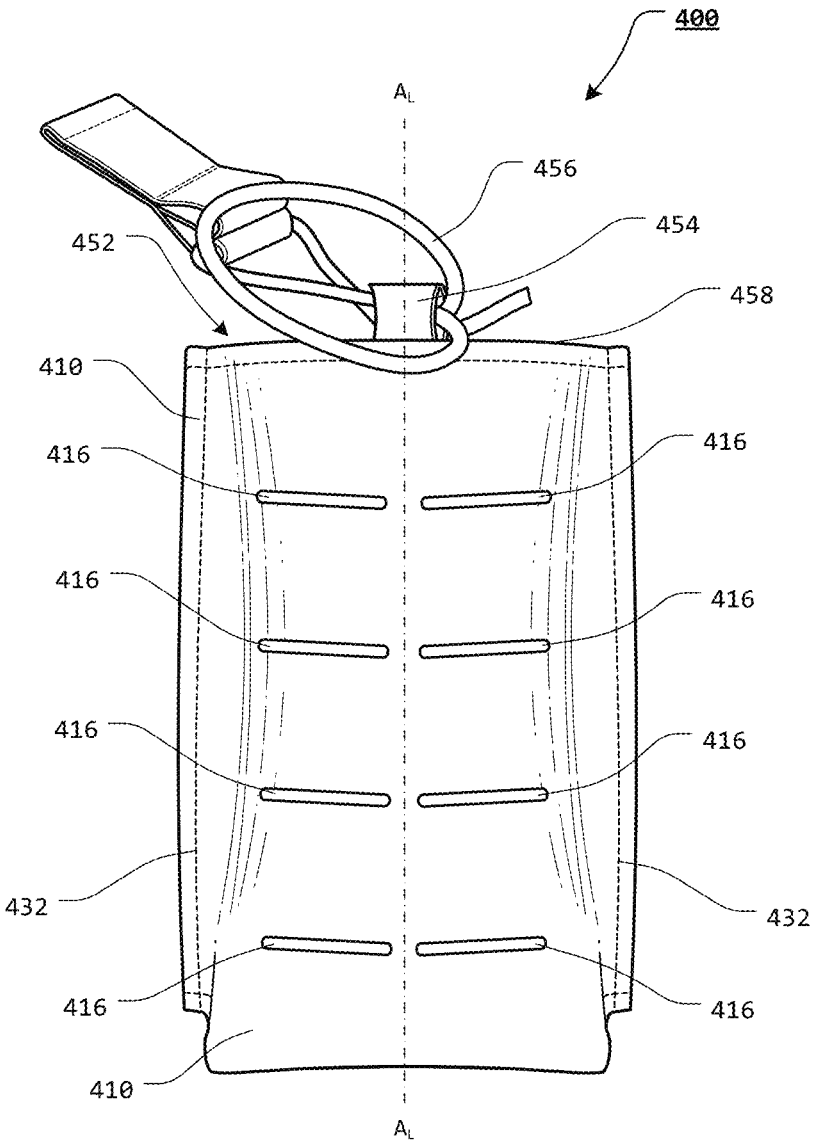
FIG. 11 illustrates a front view of an exemplary embodiment of an accessory for use in certain exemplary embodiments of a multi-panel attachment system, according to the present disclosure.

In various exemplary embodiments, as illustrated, for example, in FIG. 11, each accessory aperture 415 may optionally be formed of an elongate accessory aperture slot 416 formed through a portion of the outer accessory panel 455 or front wall of the accessory 400. Each accessory aperture slot 416 may be formed directly through the outer accessory panel 455 or front wall or formed in a front attachment interface portion 410 attached or coupled to the outer accessory panel 455 of the accessory 400.

The accessory apertures 415 may be arranged in a repeating or semi-repeating series or sequence of spaced apart, repeating patterns. In various exemplary embodiments, the accessory apertures 415 are arranged in a repeating or semi-repeating series or sequence of spaced apart rows and columns. In various exemplary embodiments, the accessory apertures 415 are arranged in a series of equally spaced rows and equally spaced columns.

In certain exemplary embodiments, each of the rows is spaced at a distance that is the same as the spacing between each of the columns. Alternatively, the spacing between each of the rows is greater than or less than the spacing between each of the columns.

In various exemplary embodiments, the spacing between either edges or proximate centers 418 of adjacent accessory apertures 415 (whether vertically, horizontally, obliquely, or diagonally adjacent) is influenced or dictated by the width of the accessory webbing element of a compatible accessory 400. For example, if the accessory webbing element has a width of approximately 1 inch, the spacing between either edges or proximate centers 418 of adjacent accessory apertures 415 may optionally be approximately 1 inch, so as to allow the accessory webbing element to be appropriately aligned between every other accessory aperture 415 in a vertical, horizontal, oblique, or diagonal direction. Alternatively, the spacing between either edges or proximate centers 418 of adjacent accessory apertures 415 may be created such that only certain accessories are compatible with the accessory apertures 415.

It should be appreciated that two or more adjacent accessory apertures 415 may comprise a row and two or more adjacent accessory apertures 415 may comprise a column. Thus, it should be appreciated that the number of accessory apertures 415 is a design choice based upon the desired size and/or functionality of the front attachment interface portion 410 and/or rear pouch panel.

In various exemplary, nonlimiting embodiments, each adjacent row and/or column of spaced apart accessory apertures 415 is offset such that either edges or proximate centers 418 of adjacent accessory apertures 415 are offset by approximately ±45°, approximately ±33°, or approximately ±90°. If for example, either edges or proximate centers 418 of adjacent accessory apertures 415 are offset by ±45°, ±33°, or ±90°, an attached or coupled compatible accessory 400 may be attached or coupled at least at ±0°, ±90°, ±33°, or ±45°. Thus, it should be appreciated that the offset of adjacent rows and/or columns dictates the angle of oblique attachment of accessories.

In certain exemplary, nonlimiting embodiments, each accessory aperture 415 may be separated from each other accessory aperture 415 by a distance that is equal to or greater than a width of each accessory aperture 415. Alternatively, each accessory aperture 415 may be separated from each other accessory aperture 415 by a distance that is equal to or greater than a width of each accessory aperture 415.

By arranging the accessory apertures 415 in a repeating or semi-repeating series or sequence, aperture array tunnel segments are created between adjacent accessory apertures 415 (whether vertically, horizontally, obliquely, acutely, or diagonally adjacent).

In certain illustrative, non-limiting embodiment(s) of the presently disclosed systems, methods, and/or apparatuses, as illustrated in FIGS. 12-13, the attachment panel 200 includes a portion of material having a panel front side 207 and an opposing panel rear side 209. The attachment panel 200 includes a panel interface portion 210 and a panel attachment portion 220 formed as integral components of the attachment panel 200.

One or more panel attachment elements 221 extend as an integral extension of a portion of the panel interface portion 210 to form the panel attachment portion 220. Each panel attachment element 221 includes an attachment panel extension portion 222 that extends from the panel interface portion 210. The attachment panel extension portion 222 extends to a terminating portion 225 having a terminal end 223. Each attachment panel extension portion 222 generally extends parallel to a longitudinal axis, $A_L$, of the attachment panel 200. In various exemplary embodiments, each panel attachment element 221 is formed of a separate portion of material that is attached or coupled to the panel interface portion 210. Alternatively, as illustrated, instead of being formed of a separate material or separate portion of material that is attached or coupled to the panel interface portion 210, each panel attachment element 221 extends as a continuation of the material used to form the panel interface portion 210 of the attachment panel 200.

It should be appreciated that the attachment panel 200 may be formed so as to include a single panel attachment element 221 extending from the panel interface portion 210 and including a single panel column 216 of panel attachment slots and at least one panel locking slot 218 and optional panel locking aperture 219. Alternatively, the attachment panel 200 may include 2 or more panel attachment elements 221 extending from the panel interface portion 210 and a corresponding panel column 216 of panel attachment slots 215 and at least one panel locking slot 218 and optional panel locking aperture 219 for each panel attachment element 221.

Attachment element notches 226 are defined by recesses formed in opposing side portions of each panel attachment element 221, between the attachment panel extension portion 222 and a terminating portion 225 of each panel attachment element 221. The attachment element notches 226 define portions of the panel attachment element 221 with a reduced width, when compared to the widths of the attachment panel extension portion 222 and the terminating portion 225.

Each attachment element notch 226 defines a shoulder 227, proximate the terminating portion 225. In various exemplary embodiments, the shoulder 227 is optionally formed substantially perpendicular to a longitudinal axis, $A_L$, of the panel attachment element 221. Alternatively, the shoulder 227 is optionally formed at an acute or obtuse angle relative to the longitudinal axis, $A_L$, of the panel attachment element 221. In these exemplary embodiments, the angle of the shoulder 227 allows the terminating portion 225 to be more firmly held within a panel locking slot 218.

A wing portion 224 extends from the shoulder 227 of each attachment element notch 226, toward the terminal end 223 of the panel attachment element 221, within the terminating portion 225 of the panel attachment element 221. In various exemplary embodiments, a width of the wing portion 224, proximate the shoulder 227, is the same or substantially the same as the width of the attachment panel extension portion 222 of the panel attachment element 221. The width of the wing portion 224 may optionally taper as the wing portion 224 extends from the shoulder 227 or proximate the shoulder 227 to the terminal end 223.

An attachment panel locking aperture 228 may optionally be formed through a portion of the panel attachment element 221, proximate the terminal end 223. If included, the attachment panel locking aperture 228 may be utilized to further assist in securing the panel attachment element 221 to the panel interface portion 210 by allowing a portion of material to be positioned through the attachment panel locking aperture 228 and the panel locking aperture 219 of the panel interface portion 210.

The panel interface portion 210 is formed so as to include a plurality of spaced apart panel attachment slots 215 formed therethrough. In various exemplary embodiments, the panel attachment slots 215 are generally formed as slots or apertures through the panel interface portion 210. Each panel attachment slot 215 is defined by one or more continuous edges.

The panel interface portion 210 of the present disclosure is operable with as few as two panel attachment slots 215. Thus, the size and shape of the panel interface portion 210 is a design choice, based upon, for example, the size and shape of the portion of panel interface portion 210 that is desired to potentially accept attachment or coupling of panel attachment element(s) 221.

In various exemplary embodiments, the size of each panel attachment slot 215 is influenced or dictated by the width of the panel attachment element(s) 221. For example, if a panel attachment element 221 has a width of approximately 1 inch, the width of the panel attachment slots 215 may optionally be slightly greater than approximately 1 inch, so as to allow the panel attachment element(s) 221 to be appropriately positioned through the panel attachment slots 215. It should be appreciated that the size and shape of each of the panel attachment slots 215 is a design choice based upon the desired functionality and/or appearance of the panel interface portion 210 and the ability of each panel attachment slot 215 to allow at least a portion of a panel attachment element 221 to pass therethrough without undue or excess movement or play within each panel attachment slot 215.

The panel attachment slots 215 are arranged in a repeating or semi-repeating series or sequence of spaced apart, repeating patterns. In various exemplary embodiments, the panel attachment slots 215 are arranged in a panel column 216. The longitudinal axis, $A_L$, of the panel column 216 is parallel to the longitudinal axis, $A_L$, of each panel attachment element 221.

It should be appreciated that two or more adjacent panel attachment slots 215 may comprise a row and two or more adjacent panel attachment slots 215 may comprise a panel column 216. Thus, it should be appreciated that the number of panel attachment slots 215 formed in the panel interface portion 210 is a design choice based upon the desired size and/or functionality of the panel interface portion 210.

By arranging the panel attachment slots 215 in a repeating or semi-repeating series or sequence, tunnel segments are created between adjacent panel attachment slots 215 (typically along a longitudinal axis, $A_L$, of a panel column 216).

One or more panel locking slots 218 are also formed within the panel column 216 of panel attachment slots 215. A width of each panel locking slot 218 generally corresponds to a width of the panel attachment element 221 between opposing attachment element notches 226 of a given panel attachment element 221. The panel locking slot 218 is typically formed proximate a location where the attachment element notches 226 will be located when the panel attachment element 221 is folded over the attachment panel 200.

In certain exemplary embodiments, a panel locking aperture 219 is also formed proximate each panel locking slot 218. Each panel locking aperture 219 is formed proximate a location where each attachment panel locking aperture 228 will desirably be positioned when the attachment element notches 226 are positioned within the panel locking slots 218. Alignment of the panel locking aperture 219 with the attachment panel locking aperture 228 allows an additional fastening element to be positioned through the aligned attachment panel locking aperture 228 and panel locking aperture 219 to further secure the terminating portion 225 of the panel attachment element 221 to the panel interface portion 210.

In various exemplary embodiments, a panel releasable fastener portion 230 is formed in or attached or coupled to at least a portion of the panel interface portion 210 on the panel front side 207. The panel releasable fastener portion 230 comprises a mating hook or loop portion that is releasably mateable or attachable with a mating hook or loop portion of the flap panel 300 releasable faster portion of the flap panel 300. In this manner, a portion of the flap panel 300 can be releasably attached or coupled to a portion of the attachment panel 200, via interaction of the panel releasable fastener portion 230 and the flap releasable fastener portion 330.

In certain exemplary embodiments, the panel releasable fastener portion 230 and/or the flap releasable fastener portion 330 may alternatively comprise other releasable fasteners or other known or later developed means or methods for releasably attaching or coupling a portion of the flap panel 300 to a portion of the attachment panel 200.

In certain exemplary embodiments, the attachment panel 200 is formed of a portion of a fabric-type or other material, such as, for example, chlorosulfonated polyethylene (CSPE) synthetic rubber (CSM). In certain exemplary embodiments, the attachment panel 200 is formed of a portion of Hypalon fabric. However, the present disclosure is not so limited. For example, in certain exemplary embodiments, the attachment panel 200 may be formed of a rigid material, a semi-rigid material, or a substantially flexible material.

In various exemplary, non-limiting embodiments, all or portions of the attachment panel 200 may be made of any fabric or other material, such as, for example, interwoven fabrics, canvas, acrylics, sheet fabrics, films, nylon, spandex, vinyl, Polyvinyl Chloride (PVC), neoprene, or the like. Alternatively, all or portions of the attachment panel 200 may be formed from multiple, similar or dissimilar materials. In various exemplary, non-limiting embodiments, the attachment panel 200 may be water-resistant or may include a cushion material.

It should be appreciated that the terms fabric and material are to be given their broadest meanings and that the particular fabric(s) or material(s) used to form the attachment panel 200 is a design choice based on the desired appearance and/or functionality of the attachment panel 200. In general, the material used to form the attachment panel 200 is selected for its ability to allow the panel attachment element (s) 221 to be appropriately interwoven between the panel attachment slots 215 of the panel interface portion 210.

While the panel interface portion 210 is illustrated as comprising a somewhat rectangular portion of material, it should be appreciated that the overall size and shape of the panel interface portion 210 is a design choice based upon the desired appearance and/or functionality of the attachment panel 200 and/or the size and/or shape of the accessory 400 to which the attachment panel 200 is to be attached or coupled or the flap panel 300 that is to be used in conjunction with the attachment panel 200.

In certain illustrative, non-limiting embodiment(s) of the presently disclosed systems, methods, and/or apparatuses, as illustrated in FIGS. 14-15, the flap panel 300 includes a portion of material having a flap front side 307 and an opposing flap rear side 309. The flap panel 300 includes a flap interface portion 310 and a flap cover portion 320 formed as integral components of the flap panel 300.

In various exemplary embodiments, the flap cover portion 320 extends as an integral extension of a portion of the flap interface portion 310. The flap cover portion 320 extends to a terminating portion 325 having a terminal end 323. The flap cover portion 320 generally extends parallel to a longitudinal axis, $A_L$, of the flap panel 300. In various exemplary embodiments, the flap cover portion 320 is formed of a separate portion of material that is attached or coupled to the flap interface portion 310. Alternatively, as illustrated, instead of being formed of a separate material or separate portion of material that is attached or coupled to the flap interface portion 310, the flap cover portion 320 extends as a continuation of the material used to form the flap interface portion 310 of the flap panel 300.

The flap interface portion 310 includes a plurality of spaced apart flap attachment slots 315 formed therethrough. In various exemplary embodiments, the flap attachment slots 315 are generally formed as slots or apertures through the flap interface portion 310. Each flap attachment slot 315 is defined by one or more continuous edges.

The flap interface portion 310 includes at least one flap column 316 of flap attachment slots 315. Alternatively, the flap panel 300 may include 2 or more flap columns 316 of flap attachment slots 315.

The flap interface portion 310 of the present disclosure is operable with as few as two flap attachment slots 315. Thus, the size and shape of the flap interface portion 310 is a design choice, based upon, for example, the size and shape of the portion of flap interface portion 310 that is desired to potentially accept attachment or coupling of accessory attachment element(s) 121.

In various exemplary embodiments, the size of each flap attachment slot 315 is influenced or dictated by the width of the accessory attachment element(s) 121. For example, if an accessory attachment element 121 has a width of approximately 1 inch, the width of the flap attachment slots 315 may optionally be slightly greater than approximately 1 inch, so as to allow the accessory attachment element(s) 121 to be appropriately positioned through the flap attachment slots 315. It should be appreciated that the size and shape of each of the flap attachment slots 315 is a design choice based upon the desired functionality and/or appearance of the flap interface portion 310 and the ability of each flap attachment slot 315 to allow at least a portion of an accessory attachment element 121 to pass therethrough without undue or excess movement or play within each flap attachment slot 315.

The flap attachment slots 315 are arranged in a repeating or semi-repeating series or sequence of spaced apart, repeating patterns. In various exemplary embodiments, the flap attachment slots 315 are arranged in a flap column 316. The longitudinal axis, $A_L$, of the flap column 316 is parallel to the longitudinal axis, $A_L$, of the flap panel 300.

It should be appreciated that two or more adjacent flap attachment slots 315 may comprise a row and two or more adjacent flap attachment slots 315 may comprise a flap column 316. Thus, it should be appreciated that the number of flap attachment slots 315 formed in the flap interface portion 310 is a design choice based upon the desired size and/or functionality of the flap interface portion 310.

By arranging the flap attachment slots 315 in a repeating or semi-repeating series or sequence, tunnel segments are created between adjacent flap attachment slots 315 (typically along a longitudinal axis, $A_L$, of a flap column 316).

In various exemplary embodiments, a flap releasable fastener portion 330 is formed in or attached or coupled to at least a portion of the flap interface portion 310 on the flap rear side 309. The flap releasable fastener portion 330 comprises a mating hook or loop portion that is releasably mateable or attachable with a mating hook or loop portion of the panel releasable faster portion of the attachment panel 200. In this manner, a portion of the flap panel 300 can be releasably attached or coupled to a portion of the attachment panel 200, via interaction of the flap releasable fastener portion 330 and the panel releasable fastener portion 230.

In certain exemplary embodiments, the flap releasable fastener portion 330 and/or the panel releasable fastener portion 230 may alternatively comprise other releasable fasteners or other known or later developed means or methods for releasably attaching or coupling a portion of the flap panel 300 to a portion of the flap panel 300.

In certain exemplary embodiments, the flap panel 300 is formed of a portion of a fabric-type or other material, such as, for example, chlorosulfonated polyethylene (CSPE) synthetic rubber (CSM). In certain exemplary embodiments, the flap panel 300 is formed of a portion of Hypalon fabric. However, the present disclosure is not so limited. For example, in certain exemplary embodiments, the flap panel 300 may be formed of a rigid material, a semi-rigid material, or a substantially flexible material.

In various exemplary, non-limiting embodiments, all or portions of the flap panel 300 may be made of any fabric or other material, such as, for example, interwoven fabrics, canvas, acrylics, sheet fabrics, films, nylon, spandex, vinyl, Polyvinyl Chloride (PVC), neoprene, or the like. Alternatively, all or portions of the flap panel 300 may be formed from multiple, similar or dissimilar materials. In various exemplary, non-limiting embodiments, the flap panel 300 may be water-resistant or may include a cushion material.

It should be appreciated that the terms fabric and material are to be given their broadest meanings and that the particular fabric(s) or material(s) used to form the flap panel 300 is a design choice based on the desired appearance and/or functionality of the flap panel 300. In general, the material used to form the flap panel 300 is selected for its ability to flex a sufficient amount to allow the flap cover portion 320 to be folded over the open top end 458, or cavity 452, of the accessory 400 to be used as a cover for the cavity 452 of the accessory 400.

While the flap panel 300, flap cover portion 320, and flap interface portion 310 are illustrated as comprising somewhat rectangular portion portions of material, it should be appreciated that the overall size and shape of the flap panel 300, flap cover portion 320, and flap interface portion 310 is a design choice based upon the desired appearance and/or functionality of the flap panel 300 and/or the size and/or shape of the accessory 400 to which the flap panel 300 is to be attached or coupled or the item that is to be used in conjunction with the accessory 400 and flap panel 300.

FIGS. 16-30 illustrate various exemplary steps for attaching an exemplary attachment panel 200 and/or an exemplary flap panel 300 to an exemplary accessory 400. For example, as illustrated in FIGS. 16-23, the attachment panel 200 is aligned with the accessory 400, such that the attachment panel extension portions 222 are aligned with the accessory apertures 415 or accessory aperture slots 416 of the accessory 400. The attachment panel extension portions 222 are then interwoven between the accessory apertures 415 and the panel attachment slots 215 (alternating between aligned accessory apertures 415 of the accessory 400 and panel attachment slots 215 of the attachment panel 200).

When the terminal ends 223 of the attachment panel extension portions 222 are interwoven so as to extend from the panel attachment slots 215 and the panel locking slots 218, the attachment panel locking apertures 228 may be aligned with the panel locking apertures 219.

Alignment of each panel locking aperture 219 with a corresponding attachment panel locking aperture 228 allows an additional fastening element to be positioned through the aligned attachment panel locking aperture 228 and panel locking aperture 219 to further secure the terminating portion 225 of the panel attachment element 221 to the panel interface portion 210.

Once appropriately attached, the attachment panel 200 is releasably or removably attached or coupled to the front portion of the accessory 400. In this manner, the panel releasable fastener portion 230 is positioned atop a portion of the front portion of the accessory 400.

As illustrated in FIGS. 24-30, the flap panel 300 is aligned with the accessory 400, such that the flap interface portion 310 is aligned with the accessory 400 such that the flap attachment slots 315 are aligned with corresponding attachment slots of the accessory 400. The accessory attachment elements 121 are then interwoven between the flap attachment slots 315 and the attachment slots (alternating between aligned flap attachment slots 315 of the flap panel 300 and attachment slots of the accessory 400).

When the terminal ends of the accessory attachment elements 121 are interwoven so as to extend from the attachment slots and the locking slot, the attachment locking apertures 119 may be aligned with the locking apertures 119.

Alignment of each interface portion locking aperture 119 with a corresponding attachment interface portion locking aperture 119 allows an additional fastening element to be positioned through the aligned interface portion locking aperture 119 and attachment interface portion locking aperture 119 to further secure the terminating portion 125 of the accessory attachment element 121 to the attachment interface portion 110.

Once appropriately attached, the flap panel 300 is releasably or removably attached or coupled to the rear portion of the accessory 400. In this manner, at least a portion of the flap cover portion 320 is able to overlay and cover a portion of the cavity 452 of the accessory 400. When the flap cover portion 320 is appropriately positioned, the flap releasable fastener portion 330 is able to releasably interact with the panel releasable fastener portion 230 to maintain the flap panel 300 in a desired position.

It should be appreciated that while the attachment panel 200 is shown and described as being attached or coupled to a front portion of the accessory 400 and the flap panel 300 is shown and described as being attached or coupled to a rear portion of the accessory 400, the present disclosure is not so limited. Therefore, it should be appreciated that the attachment panel 200 may be attached or coupled to a front portion or a rear portion of the accessory 400 and the flap panel 300 may be attached or coupled to a rear portion or a front portion of the accessory 400.

While the present disclosure has been described in conjunction with the exemplary embodiments outlined above, the foregoing description of exemplary embodiments of the present disclosure, as set forth above, are intended to be illustrative, not limiting and the fundamental disclosed systems, methods, and/or apparatuses should not be considered to be necessarily so constrained. It is evident that the present disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A multi-panel attachment system, comprising:

an attachment interface panel having an attachment interface portion and one or more accessory attachment elements extending from said attachment interface portion, wherein accessory attachment slots are formed through said attachment interface portion, wherein at least a portion of said attachment interface panel is attached or coupled to a portion of an accessory, and wherein accessory apertures are formed through said accessory;

an attachment panel having a panel interface portion and one or more panel attachment elements extending from said panel interface portion, wherein panel attachment slots are formed through said panel interface portion, wherein a panel releasable fastener portion is included within at least a portion of said panel interface portion, and wherein said attachment panel is releasably attachable to said attachment interface panel via interaction between said accessory apertures, said panel attachment slots, and panel attachment elements; and a flap panel having a flap interface portion and a flap cover portion, wherein flap attachment slots are formed through said flap interface portion, wherein a flap releasable fastener portion is included within at least a portion of said flap cover portion, and wherein said flap panel is releasably attachable to said attachment interface panel via interaction between said accessory attachment slots, said flap attachment slots, and said accessory attachment elements.

2. The multi-panel attachment system of claim 1, wherein each of said accessory apertures comprises substantially parallel sides, wherein an arcuate side joins respective upper terminal ends and respective lower terminal ends of each of said parallel sides.

3. The multi-panel attachment system of claim 1, wherein said accessory apertures are formed through a front portion of said accessory.

4. The multi-panel attachment system of claim 1, wherein said one or more accessory attachment elements are formed as integral extensions of said attachment interface portion.

5. The multi-panel attachment system of claim 1, wherein said one or more panel attachment elements are formed as integral extensions of said panel interface portion.

6. The multi-panel attachment system of claim 1, wherein attachment element notches are defined by recesses formed in opposing side portions of each accessory attachment element, proximate a terminating portion of each accessory attachment element.

7. The multi-panel attachment system of claim 1, wherein said accessory attachment slots are arranged in a repeating or semi-repeating series or sequence of spaced apart apertures.

8. The multi-panel attachment system of claim 1, wherein said panel attachment slots are arranged in a repeating or semi-repeating series or sequence of spaced apart apertures.

9. The multi-panel attachment system of claim 1, wherein said flap attachment slots are arranged in a repeating or semi-repeating series or sequence of spaced apart apertures.

10. A multi-panel attachment system, comprising:

an accessory having one or more accessory apertures formed through said accessory;

an attachment interface panel having an attachment interface portion and one or more accessory attachment elements extending from said attachment interface portion, said attachment interface portion having accessory attachment slots formed through said attachment interface portion, at least a portion of said attachment interface panel being attached or coupled to a portion of said accessory;

an attachment panel having a panel interface portion and one or more panel attachment elements extending from said panel interface portion, said panel interface portion having panel attachment slots formed through said panel interface portion, at least a portion of said panel interface portion having a panel releasable fastener portion, and said attachment panel being releasably attachable to said attachment interface panel via interaction between said accessory apertures, said panel attachment slots, and panel attachment elements; and a flap panel having a flap interface portion and a flap cover portion, said flap interface portion having flap attachment slots formed through said flap interface portion, at least a portion of said flap cover portion having a flap releasable fastener portion, and said flap panel being releasably attachable to said attachment interface panel via interaction between said accessory attachment slots, said flap attachment slots, and said accessory attachment elements.

11. The multi-panel attachment system of claim 10, wherein each of said accessory apertures comprises substantially parallel sides, wherein an arcuate side joins respective upper terminal ends and respective lower terminal ends of each of said parallel sides.

12. The multi-panel attachment system of claim 10, wherein said accessory apertures are formed through a front portion of said accessory.

13. The multi-panel attachment system of claim 10, wherein said one or more accessory attachment elements are formed as integral extensions of said attachment interface portion.

14. The multi-panel attachment system of claim 10, wherein said one or more panel attachment elements are formed as integral extensions of said panel interface portion.

15. The multi-panel attachment system of claim 10, wherein said accessory attachment slots are arranged in a repeating or semi-repeating series or sequence of spaced apart apertures.

16. The multi-panel attachment system of claim 10, wherein said panel attachment slots are arranged in a repeating or semi-repeating series or sequence of spaced apart apertures.

17. The multi-panel attachment system of claim 10, wherein said flap attachment slots are arranged in a repeating or semi-repeating series or sequence of spaced apart apertures.

18. A multi-panel attachment system, comprising:

an attachment interface panel having an attachment interface portion and one or more accessory attachment elements extending from said attachment interface portion, wherein accessory attachment slots are formed through said attachment interface portion, wherein at least a portion of said attachment interface panel is attachable to a portion of an accessory, and wherein accessory apertures are formed through said accessory;

an attachment panel having a panel interface portion and one or more panel attachment elements extending from said panel interface portion, wherein panel attachment slots are formed through said panel interface portion, and wherein said attachment panel is releasably attachable to said attachment interface panel via interaction between said accessory apertures, said panel attachment slots, and panel attachment elements; and a flap panel having a flap interface portion and a flap cover portion, wherein flap attachment slots are formed through said flap interface portion, and wherein said flap panel is releasably attachable to said attachment interface panel via interaction between said accessory attachment slots, said flap attachment slots, and said accessory attachment elements.

19. The multi-panel attachment system of claim 18, wherein said one or more accessory attachment elements are formed as integral extensions of said attachment interface portion.

20. The multi-panel attachment system of claim 18, wherein said one or more panel attachment elements are formed as integral extensions of said panel interface portion.

* * * * *